US005137097A

United States Patent [19]

Fernandez

[11] Patent Number: 5,137,097

[45] Date of Patent: Aug. 11, 1992

[54] MODULAR DRILL BIT

[75] Inventor: Carlos Fernandez, San Clemente, Calif.

[73] Assignee: Modular Engineering, San Clemente, Calif.

[21] Appl. No.: 606,087

[22] Filed: Oct. 30, 1990

[51] Int. Cl.[5] ..... E21B 10/20; E21B 10/22; E21B 10/24

[52] U.S. Cl. ..... 175/228; 175/367; 175/368; 175/370; 175/371; 384/93; 384/95; 384/96

[58] Field of Search ..... 175/367, 368, 370, 371, 175/372, 374, 375, 410, 411, 227, 228; 384/92-96, 907

[56] References Cited

U.S. PATENT DOCUMENTS

| | | | |
|---|---|---|---|
| 1,305,489 | 6/1919 | Patin | 175/372 X |
| 1,729,062 | 9/1929 | Bull | 175/368 |
| 1,858,980 | 5/1932 | Behnke | 175/368 |
| 2,075,997 | 4/1937 | Reed | 384/96 |
| 2,600,321 | 6/1952 | Pyle | 384/907 X |
| 3,199,878 | 8/1965 | Cunningham et al. | 384/94 X |
| 3,244,459 | 4/1966 | Ortloff | 175/372 X |
| 3,365,247 | 1/1968 | Ferrand | 384/94 X |
| 3,721,307 | 3/1973 | Mayo | 384/94 X |
| 3,847,235 | 11/1974 | Goodfellow | 175/372 |
| 3,915,246 | 10/1975 | Sheshtawy | 175/410 X |
| 3,935,911 | 2/1976 | McQueen | 175/372 X |
| 4,172,502 | 10/1979 | Nederveen | 175/372 X |
| 4,263,976 | 4/1981 | Lachonius | 175/370 |
| 4,298,079 | 11/1981 | Norlander et al. | 175/372 X |
| 4,367,904 | 1/1983 | Olschewski et al. | 175/370 X |
| 4,445,791 | 5/1984 | Klima | 175/370 X |
| 4,519,614 | 5/1985 | Garner | 384/94 X |
| 4,738,322 | 4/1988 | Hall et al. | 175/371 X |
| 4,765,205 | 8/1988 | Higdon | 175/369 X |
| 4,865,137 | 9/1989 | Bailey et al. | 175/370 X |
| 4,887,675 | 12/1989 | Shotwell | 384/93 X |

*Primary Examiner*—Stephen J. Novosad

*Attorney, Agent, or Firm*—Spensley Horn Jubas & Lubitz

[57] ABSTRACT

A modular drill bit mounts legs within recesses in a body which are parallel to the central axis of the body using threaded studs with tapered outer portions, in conjunction with an attached pin having recesses therein receiving the upper ends of the legs. The lower ends of the legs terminate in spindles of open face configuration rotatably receiving cones thereon for rotation via a arrangement of bushings, roller bearings and thrust bearings, and a plurality of seals which slide and therefore rotate relative to both the leg spindle and the cone with the help of pressure compensating apparatus. A bushing disposed in the cone-leg spindle interface has oil-lubricated rubber rods disposed in apertures therein to prevent lock-up on an adjacent bearing surface. The cone is held in the leg spindle by a lock nut forming one end of a race for receiving rollers of a roller bearing, in conjunction with a ring-nut secured to an extended portion of the cone protecting the leg from wear and damage. The cone-leg spindle interface is lubricated by oil containing Teflon and molybdenum and which is pumped by a main thrust bearing for recirculation through radiator apparatus in the side of the leg. Such apparatus cools the oil in response to mud sprayed by an asymmetrical arrangement of adjustable ceramic nozzles mounted in a bottom surface of the body.

41 Claims, 17 Drawing Sheets

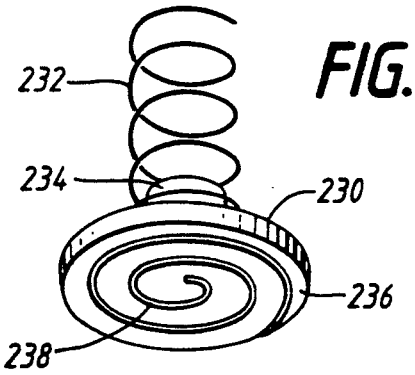
FIG. 11B
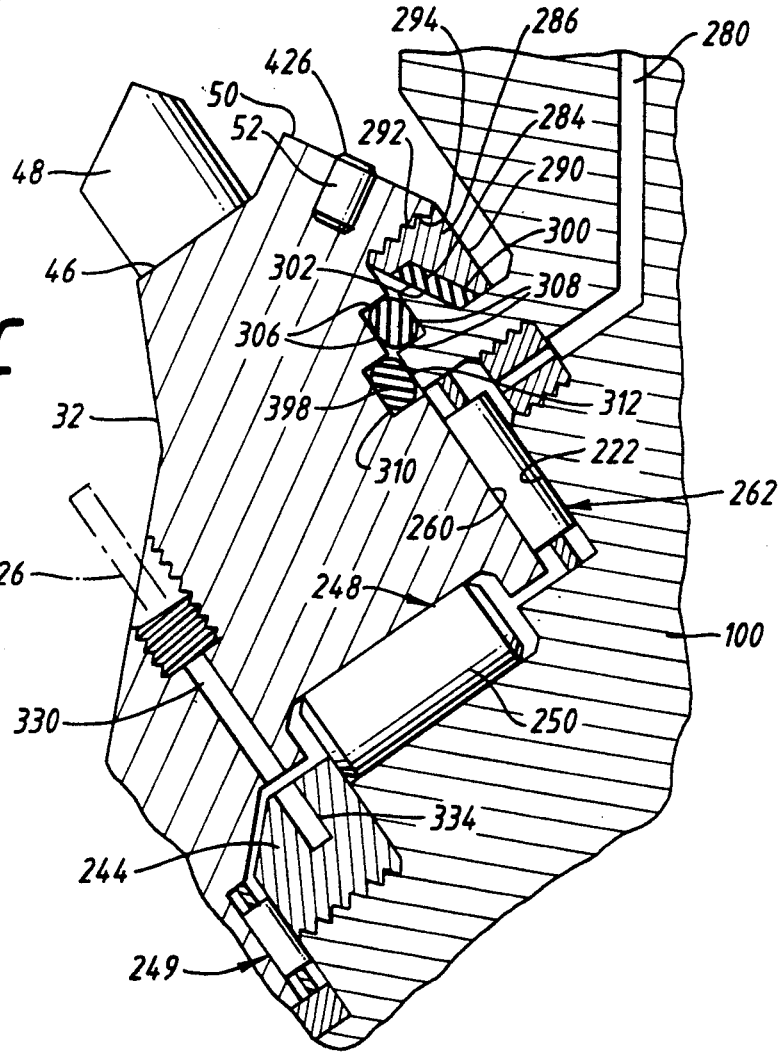
FIG. 11C
FIG. 11D
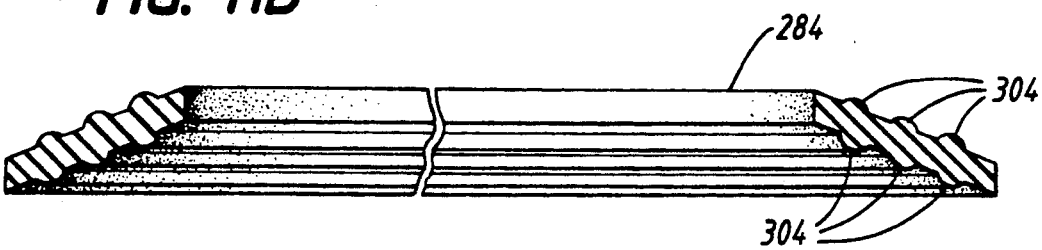

MODULAR DRILL BIT

BACKGROUND OF THE INVENTION

1. Field of the Invention

The present invention relates to rotary drill bits, and more particularly to drill bits having a plurality of rotary conical elements with cutting teeth thereon for drilling oil wells and the like.

2. History of the Prior Art

Rotary drill bits, sometimes called rock boring bits, are commonly used in the drilling of oil wells and for other ground boring requirements. Such drill bits typically employ a plurality of rotary conical elements having hardened metal tips or cutting teeth on the surface thereof. Such roller cutters or cones are rotated under the weight of a drill pipe to which the drill bit is coupled. This forces the drill bit into a rock or other ground formation, and the rotation causes the rotatably mounted cones to rotate about their own axes. The cutting teeth on the surfaces of the cones chip and crush the rock or other formations.

An example of a rotary drill bit is provided by U.S. Pat. No. 4,393,948 of Carlos Fernandez, which patent issued Jul. 19, 1983 and is entitled "Rock Boring Bit With Novel Teeth And Geometry". The Fernandez patent describes a drill bit in which a body secured to a pin has a plurality of legs mounted in equally spaced keyways therein. Each leg has a threaded support pin on an end thereof opposite the body for rotatably mounting a roller cutter in the form of a cone having a plurality of cutting teeth on the outer surface thereof. The cone is rotatably mounted on the support pin by an arrangement including a thrust plate, a pair of roller bearings and an arrangement of ball bearings. A circular seal disposed at the underside of the cone base cooperates with the leg on which the cone is mounted.

In the cones of drill bits according to the Fernandez patent, the cutting teeth are arranged in rings which extend around the central axis of the cone, with each of the rings being axially spaced along the axis and overlapping with at least one other ring and having the cutting teeth of the respective rings interspersed. The cutting teeth have edges which are disposed in oblique relationship to the axis of the cone. The edges within any one ring are disposed in oblique relationship to the rectilinear edges of at least a plurality of other cutting teeth proximate thereto.

Presently known drill bits suffer from a number of disadvantages. In conventional drill bits, the legs which mount the cones are typically angled relative to the central axis of the drill bit so as to form an outwardly extending array from the body. Such arrangement, however, is not without its limitations in terms of difficulties that may be encountered in making and assembling such a drill bit, or from the standpoint of attempting to design the drill bit for use with legs of different size. Furthermore, such conventional drill bits typically mount a plurality of mud spraying nozzles at the top of the body in an array which is not especially efficient. The body is typically bolted to a threaded pin which in turn is used to couple the drill bit to a drill pipe. As the drill pipe is rotated, substantial torque is exerted on the body with its included legs and cones, and much of this torque is in turn exerted on the body-pin interface.

Nozzles for spraying wash water or mud in conventional drill bits typically have apertures of fixed size for determining the amount of the mud spray therefrom.

Because it is customary to provide a drill bit with nozzles having different aperture sizes, it is frequently necessary that an inventory of different size nozzles be available. In addition, because such nozzles are typically made of hardened metal, they experience wear with usage and must periodically be replaced as the wear becomes great enough to alter the fixed aperture size. For air drilling, typically the nozzles are removed so that air under pressure is simply blown through the apertures in which the nozzles are mounted.

In conventional drill bits, as exemplified by the drill bit described in the previously referred to U.S. Pat. No. 4,393,948 of Fernandez, each cone is typically held on the leg on which it is mounted by an arrangement of ball bearings disposed within opposite races in the leg and in the underside of the cone. Particles of crushed rock, sand and other debris eventually enter the area between the cone and the leg and score or wear the bearings and bearing races. Eventually, the cones become separated from the legs, and are usually lost.

In conventional drill bits, provision is usually made for accommodating the thrust loads which result from the cone being pushed against the threaded support pin or spindle of the leg on which the cone is mounted. Various different thrust bearings, thrust plates or similar devices are used in an effort to accommodate the thrust loads. One common technique involves the use of thrust buttons. Such buttons are of limited size and are further limited in terms of the compression loads which can be accommodated. Other thrust bearing arrangements in conventional drill bits have similar limitations.

In certain types of conventional drill bits, a grease reservoir is provided. In the event of failure of an o-ring seal, the grease reservoir acts to inject additional lubricating grease into the bearing so as to maintain the drill bit functional for an additional period of time before ultimate failure occurs.

In conventional drill bits, the cones are typically formed using an expensive forging process. Thereafter, the cutting teeth are machined, one at a time. A hard facing material is then welded over the cutting teeth. The high temperatures involved in the welding process tend to reduce the metallic core hardening of the metal.

In conventional drill bits, gaging of the hole being drilled by the bit is typically accomplished solely by a row of cutting teeth at the outer peripheries of the cones. Such cutting teeth extend from an outer rim formed at the base of the cone. Because such rows of cutting teeth perform a gaging function to the exclusion of other backup components, they tend to wear rapidly, and this eventually exposes the cones to wear and damage.

In conventional drill bits, the bearings at the cone-leg interface are sometimes sealed using o-rings or similarly shaped seals. Such seals are typically secured to either the leg or the cone so as to undergo sliding contact with the other as the cone rotates. As a result, considerable friction is generated between the seal and the sliding surface which contacts the seal, and this results in the generation of considerable heat. Consequently, such seals tend to wear out rather quickly.

In many conventional drill bits, the central axis of each cone is offset in order to produce a slippage or scraping action in the bottom of the hole being drilled. Rows of parallel edges of the cutting teeth are located at different distances from the center of the hole, and overlap. However, there remains a gap between rows of cutting teeth where no crushing action occurs. Consequently, the three cones of a drill bit together may not crush more than about 85% of the total surface of the bottom of the hole. Manufacturing tolerances and different numbers of cutting teeth at different locations, from cone to cone, result in different torques and a consequent wobbling action. Furthermore, only one side of the cone exterior typically touches the bottom of the hole. As a result, the cones wobble and the holes being created are not straight but are more spheroid in shape. This allows the drill pipe to rub against the hole wall, requiring more driving power. Also, when the formation being drilled softens, it is not possible to increase the bit load due to a loss of direction.

Further shortcomings of the cones typically used in conventional drill bits include the tendency of the cutting teeth to enter the ground from the side thereof, which tends to bend or break the teeth. The tendency of the cutting edges of the teeth to scoop straight ahead further adds to the difficulty in drilling. Also, the large gauging teeth at the base of the cone tend not to enter the ground at the bottom edges of the hole in a very effective manner.

Conventional drill bits typically use grease as the lubricant. The use of grease is preferred in such drill bits which typically are not sealed at all, or at best are provided with some sealing action which is somewhat unreliable. However, the grease is difficult to distribute uniformly throughout the bearings and is very difficult to circulate.

In conventional bearings which utilize bushings, the bushings are typically installed in an aperture in the bearing with either a press fit or a slip fit. The slip fit is often regarded as being advantageous, inasmuch as it allows the bushing to rotate within the aperture, with a consequent reduction in friction and the heat buildup which results therefrom. Where a slip fit of the bushing is used, however, there is usually no way of determining whether the bushing is turning within the aperture or when it may have become stuck within the aperture due to such things as heat expansion.

BRIEF SUMMARY OF THE INVENTION

In modular drill bits according to the invention, a body for mounting a plurality of cone-carrying legs is provided with equally spaced keyways having back walls which are parallel to the central axis of the drill bit. This allows the legs which are mounted within such keyways to extend in directions generally parallel to the central axis of the drill bit, thereby facilitating manufacture and installation of the legs, as well as the ability to readily make legs of different lengths for use with the body.

In accordance with a feature of the invention, the mud nozzles are mounted in an asymmetrical arrangement of holes at a first end of the body. In this manner, one of the nozzles is disposed close to the center, with the other nozzles having increased distances from the center. The nozzle which is located the greatest distance from the central axis of the body can be disposed at an angle to the outside of the central axis to wash an area larger than the diameter of the body. A central intake aperture at an opposite end of the body is coupled to the nozzlemounting holes at the first end of the body through a manifold of passages within the body. The nozzles are secured within the holes in the body by threaded nut rings which are received by threads in the portions of such apertures adjacent the surface of the first end of the body.

In accordance with a further feature of the invention, torque exerted on the body-pin interface is reduced by providing a flanged end portion of the pin adjacent the body with pockets that align with the keyways of the body and receive end portions of the legs mounted within the keyways of the body.

Nozzles according to the invention are adjustable so that the mud spray therefrom can be varied from a maximum flow down to no flow at all. This is accomplished using a generally cylindrical body in conjunction with a disk disposed adjacent the a first end thereof. A mud passage extends through the body and terminates at a slot in the first end thereof, which slot is offset relative to the central axis of the body so as to form a particular pattern. The disk has an offset slot therein in a like pattern. Therefore, by rotating the disk relative to the cylindrical body, the size of the opening formed by the adjacent like patterns with their included slots is varied from a maximum opening to no opening at all. The interface between the disk and the cylindrical body is sealed by a rubber seal. After the disk is rotated to a desired position relative to the cylindrical body, a ring nut which engages a threaded portion of the aperture in which the nozzle is mounted is tightened to prevent rotation of the disk relative to the body. Rotation of the body within the aperture is prevented by a dowel pin extending from an opposite second end of the cylindrical body into a hole in the inner end of the aperture.

In accordance with a feature of the invention, the nozzles are made of ceramic material. The ceramic material resists wear, enabling the nozzles to remain in service for a very long period of time.

In accordance with a further feature of the invention, special air nozzles are used during air drilling. Each air nozzle has an upper converging portion and a lower diverging portion which accelerate the entering pressurized air to supersonic speeds as well as substantially lowering the temperature of the air. This results in more effective penetration, as well as momentary freezing of the hole button which improves the ground cutting action.

In accordance with the invention, the faces of the rollers in a roller bearing disposed between the cone and the leg are utilized to lock the cone to the leg. The rollers are disposed partly within a race in the inner surface of the cone and partly within a race in the outer surface of a spindle at the end of the leg. During installation of the cone on the spindle of the leg, a lock nut is secured on the outside of the spindle so as to form one end of the race in the spindle. By making the tolerances or allowed spaces between the opposite ends of the rollers and the associated surfaces of the races relatively small, sand and other foreign matter which might otherwise enter such spaces is confined to the cylindrical outer surfaces of the rollers where it is crushed in order to prevent scoring and wear of the bearing and race surfaces. The race in the outer surface of the spindle may be made slightly wider than the race in the inner surface of the cone to allow enough axial movement of the cone relative to the spindle to accommodate the shock absorbing action of a spring and a beryllium copper washer disposed inside the tip of the cone.

In accordance with the invention, a standard roller thrust bearing capable of handling over 20 times more thrust load than the thrust buttons of conventional drill bits is used. The thrust bearing is advantageously located between the leg and the cone so as to minimize or eliminate the unwanted pumping action that occurs in conventional drill bits due to the air gap between the two members. The roller thrust bearing is of substantial size and is located to the outside of the main roller bearing so that it is just inside of and adjacent to the base at the outer periphery of the cone. The roller thrust bearing is of generally ring-like configuration and lies within a plane perpendicular to the axis of rotation of the cone. A second roller thrust bearing can be located inside of the main thrust bearing to help accommodate the severe thrust loads imposed on drill bits of smaller diameter which are typically used for deeper drilling.

In accordance with the invention, oil instead of grease is used to provide bearing lubrication, and the pressure on opposite sides of the seals is equalized to facilitate circulation of the lubricating oil to the bearings within the cone-leg interface. Pressure equalization is achieved through a pressure compensator located within an aperture extending along the central axis of the spindle of the leg. The pressure compensator includes a flexible bellows assembly which expands and contracts as necessary to equalize the pressure.

In accordance with a feature of the invention, the roller thrust bearing is mounted within a race in the spindle of the cone located to the outside of the race in the spindle for receiving the rollers of a main roller bearing. Such arrangement provides the spindle with an open face configuration which greatly facilitates the grinding operation used to form the spindle at the end of each leg. A hole extending through the central axis of the spindle between opposite outside surfaces of the leg facilitates mounting of the leg for grinding. The ability to mount the legs in this fashion together with the open face configuration of the spindle to be formed thereon enables grinding of the legs using large grinding wheels. This is highly advantageous over the small grinding wheels which typically must be used to grind the legs in conventional drill bits.

In accordance with a further feature of the invention, the roller thrust bearing acts as a centrifugal bearing oil pump for lubricating oil introduced at the inside of the bearing. Seals located just outside of the bearing prevent the lubricating oil from escaping therethrough. Instead, the oil is recirculated to a radiator formed within the leg adjacent an outer surface thereof so that the radiator is exposed to the relatively cool water and mud circulating around the outside of the drill bit. The circulating mud and water cool the radiator which has a tortuous, zig-zag passage therethrough for the lubricating oil. This cools the lubricating oil before being recirculated to the cone-leg spindle interface through a magnetic bushing. The magnetic bushing removes any metallic particles which may accumulate in the lubricating oil. Because the lubricating oil is cooled in this fashion, the seals at the cone-leg spindle interface remain relatively cool. Inasmuch as such seals are usually made of rubber or similar materials which tend to deteriorate rapidly at higher temperatures, the resulting seal life in bearings according to the invention is greatly enhanced.

In accordance with the invention, cones are made using a process in which holes are drilled in the cone. Cutting teeth are then formed by cutting bars of very hard metal into slugs and machining the slugs. The cutting teeth as so formed are then installed in the holes in the cone. A small reservoir is formed at the bottom of each hole as it is drilled in the cone, and a small quantity of copper or nickel paste or other bonding material is placed within the reservoir prior to inserting the cutting tooth therein. Following installation of the cutting teeth in the holes, the cone structure is placed in a furnace and heated to a temperature sufficient to melt the bonding material. By capillary action the nickel, copper or other brazing metal in the bonding material at the bottoms of the holes wets the surfaces of the cutting teeth and the holes to braze the cutting teeth within the holes upon cooling. Such process of forming the cutting teeth on the cones avoids the high temperatures involved when welding is used in accordance with conventional processes.

In accordance with the invention, each cone in a drill bit is provided with an extended surface having a row of ceramic buttons installed therein. The extended surface is located adjacent and on the opposite side of the outer rim of the cone from the main outer conical surface thereof. The ceramic buttons are mounted in holes in the extended surface of the cone so that the chamfered faces thereof protrude by only a small distance from the extended surface of the cone. The row of cutting teeth on the outer rim of the cone performs the basic gaging function, but the ceramic buttons which are located just inside of such cutting teeth perform a backup gaging function as the cutting teeth wear. The chamfered outer faces of the ceramic buttons and the manner in which they are mounted in holes in the extended surface of the cone subjects the buttons to compression forces. Because ceramic material is highly resistive to wear when subjected to compression forces, such buttons wear extremely well.

In accordance with a feature of the invention, providing each cone with an extended surface acts to protect the leg from wear and damage. In conventional drill bits, loose pieces of rock tend to rub against the leg, eventually wearing away the thin edge of the leg and allowing debris to reach the bearing surfaces. It is therefore common practice in such conventional drill bits to weld a hard facing material on the edge of the leg. The extended surface of cones according to the invention increases the distance between the surface of the leg and the wall of the hole so as to reduce wear and damage to the legs. The extended surface of the cone is protected by the ceramic buttons.

In accordance with a further feature of the invention, a ring nut is mounted at the end of the protruding portion of the cone formed by the extended surface. The outside face of the ring nut is angled away from the hole wall and is comprised of wear resistant material. A washer seal disposed just inside of the ring nut is made of rubber containing solid lubricant particles to facilitate rotation of the washer seal relative to the adjacent surfaces. Concentric ribs are formed on the washer seal, and a non-water soluble grease disposed between the ribs forms a labrynth of sealing stages. In the event the bearings fail due to leakage or destruction of the washer seal or other seals mounted within the cone-leg interface, the ring nut prevents the cone from separating from the leg and becoming lost. A rotatable pre-seal for providing further sealing action is disposed inside of and adjacent the washer seal.

In accordance with the invention, the cone-leg spindle interface is provided with seals which are free to slip and to therefore rotate relative to both the leg and the cone. Thus, if the cone rotates relative to the leg at a given speed, each seal in turn rotates relative to the leg at approximately half the given speed. Inasmuch as friction is a function of the square of the velocity, such arrangement subjects the seals to approximately one fourth the amount of friction present in conventional sealing arrangements. The reduction in friction provides a consequent reduction in temperature, which adds substantially to the longevity of the seals.

In accordance with a feature of the invention, the cone-leg spindle interface is provided with a plurality of seals. Should one of the seals fail, the remaining seal or seals act as a backup to provide continued sealing action. The plural seals may include a washer seal, a pre-seal and a back-up seal. As previously described, the washer seal is disposed between the leg and the ring-nut mounted on the cone at the base thereof to seal the interface between the leg and the ring-nut. The pre-seal is disposed inside of and adjacent the washer seal and acts to further seal the cone-leg spindle interface inside of the washer seal. The back-up seal which is disposed inside of the pre-seal and just outside of the roller thrust bearing provides further sealing action in the event the washer seal and the pre-seal should fail, in addition to preventing the escape of lubricating oil centrifically circulated through the thrust bearing.

In accordance with the invention, the orientation or angulation of each cutting tooth on the cones is chosen relative to the direction of rotation of the cone so that the cutting tooth enters the ground at an angle to compress the ground before it passes the bottom of the drill bit. The ground is crushed in a stable and predictable manner. This results in part from the cones being symmetrical. The cutting teeth are offset relative to axes extending through the tip of the cone at the central axis in a manner which provides a variable pitch pattern. Also, each cone has the same number of cutting teeth, although opposite halves of each cone have different numbers of cutting teeth. This prevents cone wobbling as well as avoiding unwanted resonance. Except for the outer rim of the cone, the cutting teeth are located at different distances from the center of the cone to assure that the entire side shell of the cone crushes the entire surface of the ground. Unlike conventional bits in which three overlapping cones at most crush approximately 85% of the ground at the bottom of the hole, each cone in drill bits according to the invention crushes substantially the entire bottom surface of the hole. The angulation of the cutting teeth enables them to enter the ground in straight fashion, utilizing compression forces on the cutting teeth almost exclusively and avoiding side forces by entering the ground sideways. The cutting teeth shovel the ground instead of scrapping it, thereby effectively becoming a ground rotary shovel. The cutting edges scrape the ground upon exiting in a manner which resharpens the edge, thereby adding to drilling life.

Further in accordance with the invention, the chisel or cutting edges of the cutting teeth are not parallel to axes extending through the center of the cone, but rather are inclined in order to generate an outward ground pumping action. This provides additional ground cutting circulation in a desired direction which is away from the center of the hole. The cutting teeth at the outer rim of the cone are also angled, but the cutting edge of every other one is inclined in an opposite direction to generate a criss-cross crushing configuration. Such configuration creates non-parallel cracks in the bottom of the hole, thereby providing an asymmetric crushing pattern to achieve higher drilling efficiency. Should the bearings fail, the cone will not be lost from the leg inasmuch as the cutting teeth covering the entire outer surface of the cone do not allow sufficient room for the cone to disengage from the leg. Both sides of the downwardly facing portion of the cone touch the hole bottom to prevent wobbling through rolling of the cone.

In modular drill bits according to the invention, the extensive and reliable sealing action provided by the use of plural seals in the cone-leg spindle interface permits the use of oil as the lubricant. The oil, which can be recirculated through a cooling radiator to maintain temperature control as previously described, is introduced to the bearings at the inner portions thereof where it is distributed to all parts of the bearings in relatively uniform fashion through centrifugal action.

Lubricating oils in accordance with the invention contain solid lubricant particles in an oil base. In a preferred form, the oil includes particles of molybdenum and polytetraflourethylene (Teflon). The molybdenum particles and the Teflon particles each comprise approximately 15% of the total volume of the lubricating oil.

In accordance with the invention, the walls of a bearing bushing disposed within the cone-leg spindle interface are provided with an asymmetrical arrangement of holes. In addition, oil grooves which communicate with the holes are provided in the bushing surfaces. Rubber rods having a length 5–25% longer than the thickness of the bushing wall are installed in at least some of the holes. Because of the small clearance between the rubber rods and the walls of the opposite bearing surfaces, the rubber rods function like linear retainers or clutches. Friction is generated at the surfaces of the rubber rods, to rotate the bushing. The outside faces of the rubber rods balance the friction at both ends thereof, forcing the bushing to turn at approximately one half the rotational speed of the cone relative to the leg spindle.

BRIEF DESCRIPTION OF THE DRAWINGS

A better understanding of the invention may be had by reference to the following specification in conjunction with the accompanying drawings, in which:

FIG. 11B is an exploded perspective view of a washer and spring arrangement at the tip of the spindle of FIG. 11A for absorbing shock loads on the cone;

FIG. 11C is an enlarged view of a portion of the sectional view of FIG. 11A showing the sealing arrangement in greater detail;

FIG. 11D is a sectional view of the washer seal in the arrangement of FIG. 11A;

DETAILED DESCRIPTION

Figure 1:
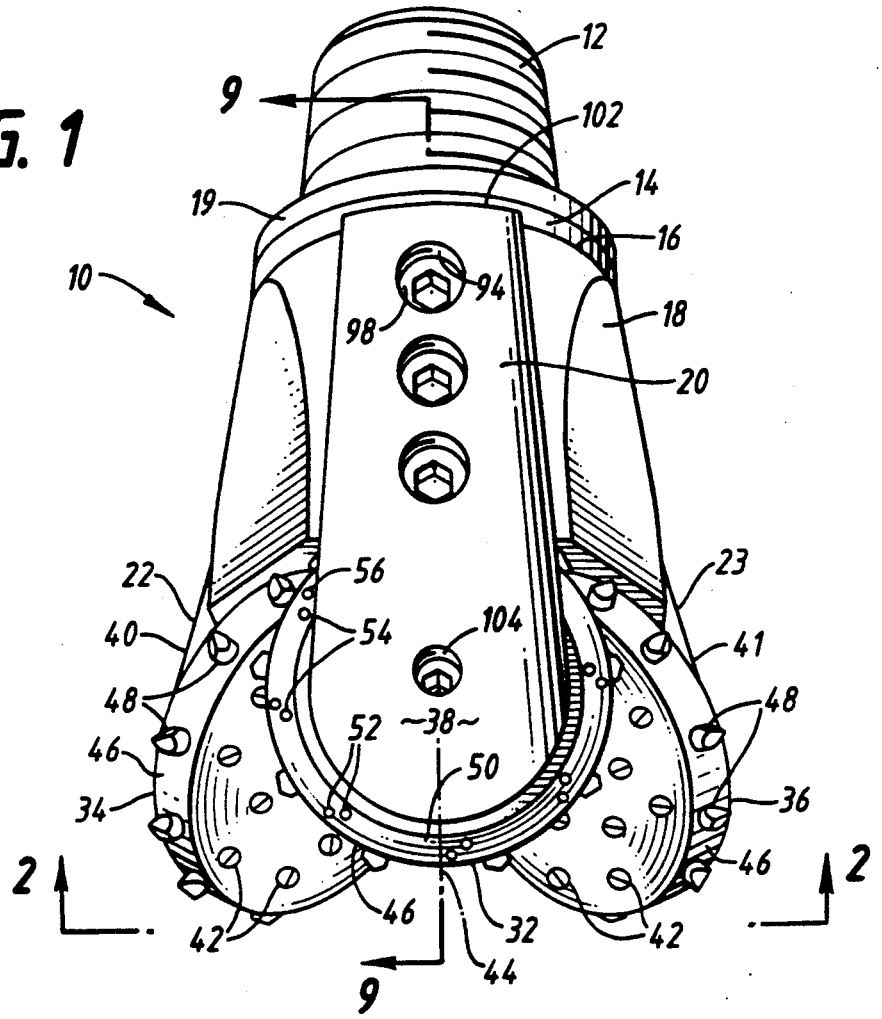
FIG. 1 is a perspective view of a modular drill bit according to the invention.

FIG. 1 shows a modular drill bit 10 in accordance with the invention. The drill bit 10 includes a threaded pin 12 having a flanged portion 14 of enlarged diameter at an end thereof for coupling to an end 16 of a body 18. A washer 19 is disposed over the threaded pin 12 so as to reside on the flanged portion 14, as described hereafter. The threaded pin 12 is adapted to couple the drill bit 10 to the lower end of a drill pipe (not shown) of conventional configuration.

Figure 3:
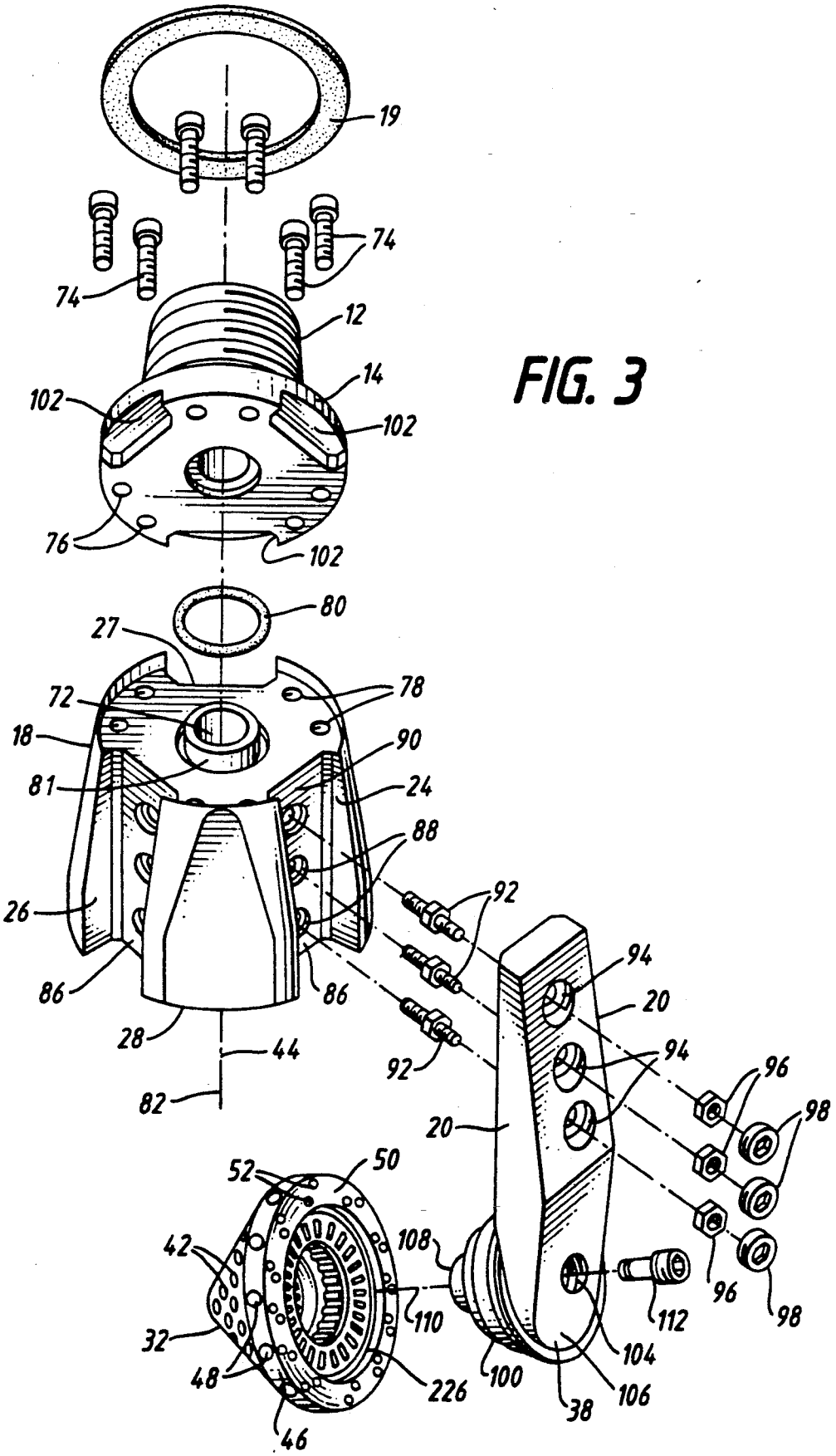
FIG. 3 is an exploded perspective view of a portion of the modular drill bit of FIG. 1 showing the threaded pin, the body and one of the legs and the associated cone thereof.

The modular drill bit 10 of FIG. 1 includes three different elongated legs 20, 22 and 23 of like configuration. The leg 20 is shown in FIG. 1 with the legs 22 and 23 being largely hidden from view except for small portions thereof. As described in detail hereafter the three legs 20, 22 and 23 are mounted on the body 18 within a plurality of keyways generally equally spaced about the body 18. As shown in FIG. 1, the leg 20 is mounted within a keyway 24. The legs 22 and 23 are respectively mounted in keyways 26 and 27 in the body 18. The keyways 26 and 27 are shown in FIG. 3, together with the keyway 24.

Figure 2:
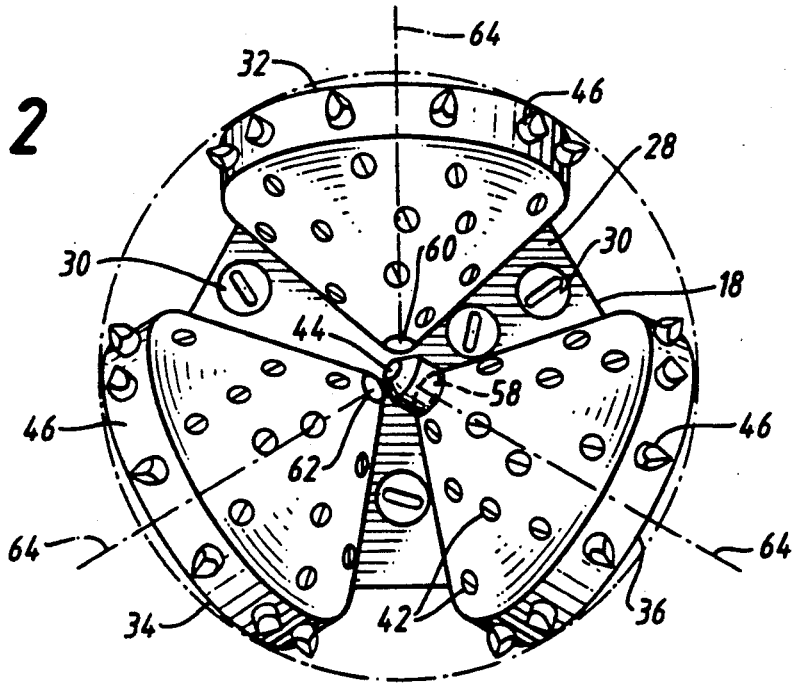
FIG. 2 is a bottom view of the modular drill bit of FIG. 1.

As shown in FIG. 2, the body 18 has an end 28 thereof opposite the end 16 in which a plurality of nozzles 30 are mounted. As described in detail hereafter, the nozzles 30 which spray a "mud" or cleaning water solution supplied from the drill pipe via internal apertures in the threaded pin 12 and the body 18 are individually adjustable and are disposed on the end 28 in an asymmetrical pattern so as to spray a plurality of cones 32, 34 and 36 mounted on the legs 20, 22 and 23, respectively, and the bottom surface of the hole being drilled by the modular drill bit 10, all in relatively uniform fashion.

The cones 32, 34 and 36 are rotatably mounted on ends 38, 40 and 41 of the legs 20, 22 and 23, respectively. The cones 32, 34 and 36 are of similar configuration and are provided with a plurality of tips or cutting teeth 42 thereon. Rotation of the cones 32, 34 and 36 in response to movement of the legs 20, 22 and 23 about a central axis 44 of the modular drill bit 10 causes the cutting teeth 42 to enter the ground formation at the bottom of the hole being drilled by the drill bit 10. The cutting teeth 42 function to cut or break the soil, clay, rocks and other material at the bottom of the hole.

As shown in FIG. 1, each of the cones 32, 34 and 36 has a rim 46 at an outer periphery or portion thereof of largest diameter on which a row of cutting teeth 48 are mounted. The cutting teeth 48 are similar to but substantially larger than the cutting teeth 42 and provide the primary gauging function for the drill bit 10. In addition, each cone 32, 34 and 36 has an extended surface 50 adjacent the rim 46 in which a plurality of ceramic buttons 52 are mounted. The ceramic buttons 52, which provide a backup or secondary gauging function in the event of wear or damage to the cutting teeth 48, are arranged into two different concentric rows on the extended surface 50. As shown in FIG. 1, the ceramic buttons 52 within a second such row 54 are disposed inside of and slightly offset relative to the ceramic buttons 52 within a first or outer row 56.

FIG. 2 is a bottom view of the modular drill bit 10 of FIG. 1 showing the cones 32, 34 and 36 and the end 28 of the body 18. As shown in FIG. 2, the cone 36 has a nose or tip 58 which is slightly longer than the tips 60 and 62 of the cones 32 and 34. In this manner, the cutting teeth 42 mounted on the tip 58 of the cone 36 are disposed within a central region of the drill bit 10 adjacent the central axis 44 so as to present a generally continuous pattern of cutting teeth to the bottom of the hole being drilled in conjunction with the cones 32 and 34.

As also shown in FIG. 2, each of the cones 32, 34 and 36 has a central axis 64 thereof about which the cones rotate. The central axes 64 of the cones 32, 34 and 36 intersect the central axis 44 of the drill bit 10, rather than being offset therefrom as in the case of certain prior art drill bits. As described hereafter, the arrangement of the cones as shown in FIG. 2 enables both sides of the downwardly facing portions of the cones 32, 34 and 36 to engage the bottom surface of the hole. This results in improved drilling performance.

FIG. 3 shows the threaded pin 12 and the body 18 together with the leg 20 and the associated cone 32. The threaded pin 12 has a central aperture 70 extending therethrough for delivering mud supplied by the drill pipe. The central aperture 70 communicates with a central aperture 72 extending into the body 18 from the end 16 thereof when the threaded pin 12 is coupled to the body 18.

The threaded pin 12 is coupled to the body 18 by a plurality of bolts 74. The bolts 74 extend through apertures 76 in the flanged portion 14 of the threaded pin 12 and into threaded apertures 78 in the body 18. A ring-shaped seal 80, disposed between the threaded pin 12 and the body 18, seats within a circular groove 81 in the upper end 16 of the body 18 to seal the interface between the pin 12 and the body 18 around the central apertures 70 and 72.

The washer 19 is disposed over the flanged portion 14 of the threaded pin 14 following installation of the bolts 74 through the apertures 76 and into the apertures 78 to couple the body 18 to the pin 12. The washer 19 which receives the lower edge of the drill pipe has an inner surface which seals to the base of the threaded pin 12.

As previously noted, the body 18 has three keyways therein which are equally spaced about a central axis 82 of the body 18. The keyways 24, 26 and 27 receive the legs 20, 22 and 23 therein, respectively. Each of the keyways 24, 26 and 27 has a back wall 86 thereof having three threaded apertures 88 spaced along a centerline 90 thereof for receiving three different studs 92.

As described in detail in connection with FIGS. 9 and 10, the studs 92, which are mounted within the threaded apertures 88 in the keyway 24, extend through apertures 94 in the leg 20 and receive nuts 96 and then safety nuts 98 to mount the leg 20 within the keyway 24. The legs 22 and 23 are mounted in the keyways 26 and 27 in similar fashion.

The leg 20 extends downwardly from the body 18 and terminates in a spindle 100. As described in detail in connection with FIG. 11, the spindle 100 rotatably mounts the cone 32 thereon. The legs 22 and 23 mount the cones 34 and 36 thereon in similar fashion.

In accordance with the invention, the centerlines 90 of the back walls 86 of the keyways 24, 26 and 27 are parallel with the central axis 82 of the body 18, such that the keyways 24, 26 and 27 are parallel to the central axis 44 of the modular drill bit 10 which is coincident with the central axis 82. As a result, the legs 20, 22 and 23 extend from the body 18 in directions generally parallel with the central axis 44 of the modular drill bit 10. This facilitates the use of different legs in the modular drill bit 10. Unlike prior art drill bits in which the legs are typically mounted so as to extend outwardly at an angle from the body, legs of different length can be installed in the modular drill bit 10 without regard to the length of the leg and therefore the extent of outward extension of the leg.

In accordance with a further feature of the invention, the threaded pin 12 is provided with three different recesses 102 at the underside of the flanged portion 14 thereof. The recesses 102 align with the keyways 24, 26 and 27 when the threaded pin 12 is mounted on the body 18, and receive the upper ends of the legs 20, 22 and 23 therein. In prior art drill bits, the legs are typically mounted exclusively within keyways or other recesses in the body. This results in considerable torque at the pin-body interface in response to rotational forces on the legs. By extending the upper ends of the legs 20, 22 and 23 into the recesses 102 in accordance with the invention, the flanged portion 14 of the threaded pin 12 is also subjected to the torque, and this reduces the torque exerted on the pin-body interface.

As shown in FIG. 3, the leg 20 has an aperture 104 therein which extends between a surface 106 of the leg 20 and an opposite surface 108 at the spindle 100. The aperture 104, which extends along a central axis 110 of the spindle 100, has a pressure compensator assembly 112 mounted therein. As described hereafter in connection with FIG. 13, the pressure compensator assembly 112 responds to pressure differentials between the outside of the leg 20 and the interface of the cone 32 with the spindle 100 to adjust the pressure within the interface so that the seals at the interface can operate in desired fashion.

Figure 4:
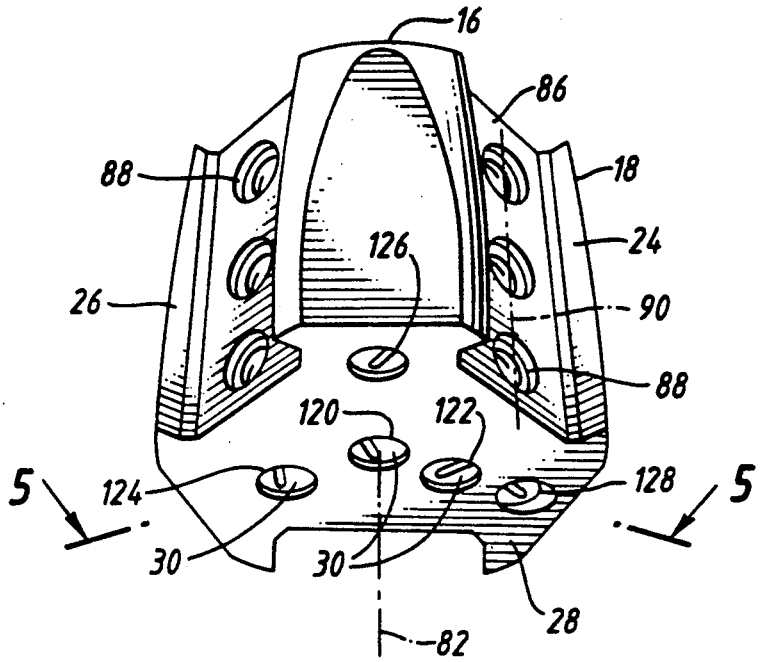
FIG. 4 is a perspective view of the modular drill bit of FIG. 1 showing the arrangement of a plurality of mud nozzles at one of the ends thereof.

FIG. 4 is a perspective view of the body 18 which is different from the perspective view of FIG. 3 and which shows the end 28 of the body 18. As previously noted, the end 28 is provided with a plurality of the nozzles 30 for spraying mud provided by the drill pipe. The mud may comprise a conventional mixture of cleaning water such as water with Bentonite mixed in. As shown in FIG. 4, there are five nozzles 30 in the present example. In accordance with the invention, the nozzles 30 are arranged in an asymmetrical pattern and are adjusted to vary the spray of mud therefrom in order to provide a relatively uniform delivery rate per area to the various portions of the area being sprayed with mud.

As shown in FIG. 4, the nozzles 30 include a first nozzle 120 located near the central axis 82 of the body 18 and four additional nozzles 122, 124, 126 and 128. The nozzle 122 is positioned adjacent the nozzle 120 but at a slightly greater distance from the central axis 82. The nozzle 124 is positioned so as to be a greater distance from the central axis 82 than the nozzle 122. The nozzles 126 and 128 are located so as to be at even greater distances from the central axis 82. The nozzles 120, 122, 124 and 126 are mounted with their central axes normal to the end 28 of the body 18. The nozzle 128 is not perpendicular but is angled, as described hereafter in connection with FIG. 5.

Figure 6A:
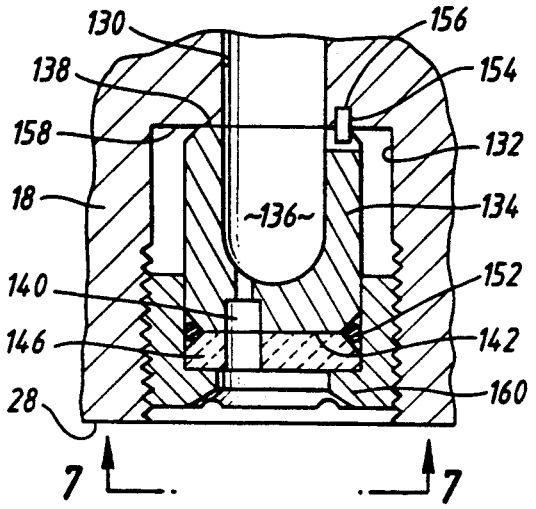
FIG. 6A is a detailed sectional view of one of the mud nozzles shown in FIG. 4.
Figure 7:
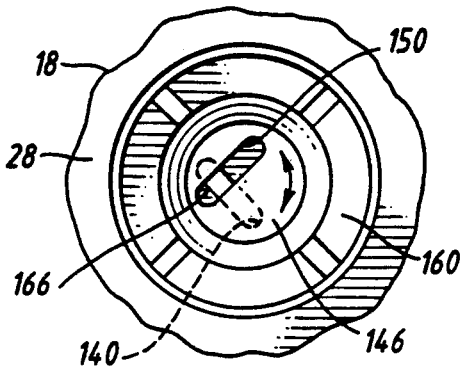
FIG. 7 is an end view of the mud nozzle of FIG. 6A.
Figure 8:
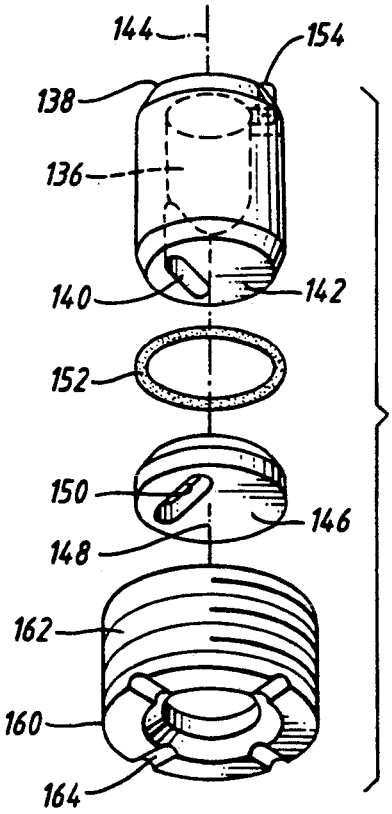
FIG. 8 is an exploded perspective view of the mud nozzle of FIG. 6A.

As described hereafter in connection with FIGS. 6A, 7 and 8, the nozzles 120, 122, 124, 126 and 128 are individually adjustable so that the flow of mud therethrough can be varied. The nozzle 120 located adjacent the center of the body 18 is adjusted to provide the least amount of flow therethrough. This is because the nozzle 120 sprays a relatively small portion of the total spray area including those portions of the cones 32, 34 and 36 and the surface of the hole being drilled which are immediately below the body 18. The nozzles 122, 124 and 126 are adjusted to provide increasing flows with greater distance of each nozzle from the center of the body 18. The greater the distance a nozzle is from the center of the body 18, the greater is the area that is sprayed. The nozzles 120, 122, 124 and 126 are adjusted so as to deliver mud to all portions of the area being sprayed at a relatively constant and uniform rate.

Figure 5:
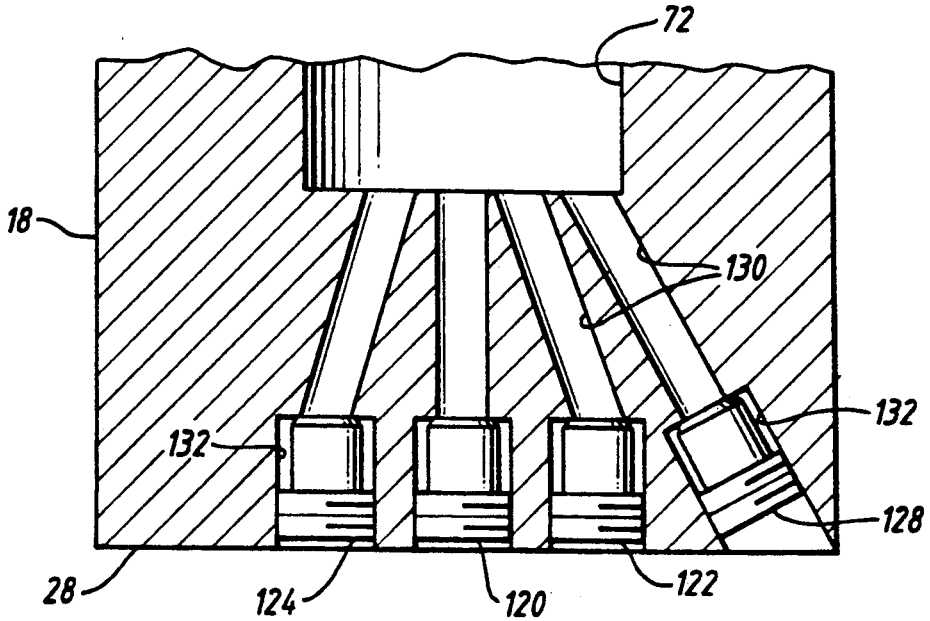
FIG. 5 is a sectional view of the body taken along the line 5—5 of FIG. 4 and showing a manifold of apertures therein for coupling the mud nozzles to a common internal, mud delivering aperture.

The angled nozzle 128 is aimed toward the outside of the body 18, as shown in FIG. 5. This enables mud to be sprayed to areas outside of the bottom of the hole being drilled if desired. When relatively short legs are mounted on the body 18, the angled nozzle 128 is usually not needed and is shut off. Conversely, when relatively long legs are used, the angled nozzle 128 is typically adjusted to provide a desired amount of mud spray to the outside.

The details of the nozzles 120, 122, 124, 126 and 128, and the manner in which they ar mounted in the end 28 of the body 18 are illustrated in FIGS. 6A, 7 and 8. As shown in FIG. 5, the central aperture 72 which extends into the body 18 from the end 16 thereof terminates in a manifold of apertures 130 which extend to the inner ends of a plurality of larger apertures 132 in the end 28 of the body 18. In this manner, mud supplied by the drill pipe which flows through the central aperture 70 in the threaded pin 12 and into the central aperture 72 in the body 18 is distributed by the apertures 130 to the larger apertures 132 in which the nozzles 120, 122, 124, 126 and 128 are mounted. Each of the larger apertures 132 has a wall which is threaded adjacent the end 28.

As shown in FIGS. 6A, 7 and 8, each nozzle is comprised of a cylindrical member 134 having an aperture 136 extending through a portion of the length thereof from a first end 138 and terminating at a slot 140 which extends to an opposite second end 142. The cylindrical member 134 has a central axis 144, and the slot 140 is offset from the central axis 144 so as to define a particular slotted pattern at the second end 142 of the cylindrical member 134. With the cylindrical member 134 installed in one of the larger apertures 132 in the end 28 of the body 18, the aperture 136 communicates with the associated aperture 130 to receive mud therein and to deliver such mud to the slot 140.

Each of the nozzles also include a disk 146 having a central axis 148 and having a slot 150 therein which is offset from the central axis 148 so as to form a slotted pattern like the pattern formed at the second end 142 of the cylindrical member 134. With the cylindrical member 134 disposed in one of the larger apertures 132, the disk 146 is located within the larger aperture 132 adjacent the second end 142 of the cylindrical member 134 so that the central axis 148 thereof is generally coincident with the central axis 144 of the cylindrical member 134. A ring-shaped rubber seal 152 is disposed between bevelled edges of the disk 146 and the second end 142 of the cylindrical member 134.

When the cylindrical member 134 is seated within one of the larger apertures 132, rotation of the cylindrical member 134 is prevented by a dowel pin 154 which extends from the first end 138 of the cylindrical member 134 and is received within a hole 156 in a bottom surface 158 of the larger aperture 132 where the aperture 132 connects with the aperture 130.

The cylindrical member 134 and the disk 146 are maintained within the large aperture 132 by a nut 160 having a threaded outer surface 162 for engaging the threaded portion of the larger aperture 132. The nut 160 has a grooved face 164 facilitating engagement thereof by a tool to tighten the nut 160 within the larger aperture 132.

The slotted patterns of the disk 146 and the second end 142 of the cylindrical member 134 enable the slots 140 and 150 to cooperate in producing a common opening therebetween which varies in size as the disk 146 is rotated relative to the cylindrical member 134. FIG. 7 shows one particular orientation of the disk 146 in which the opening provided is illustrated by the shaded area 166. Rotation of the disk 146 in a clockwise direction from the position shown in FIG. 7, looking down upon the plane of the drawing, increases the opening represented by the shaded area 166 so that a greater flow of mud through the nozzle results. Continued rotation of the disk 146 in the clockwise direction eventually causes the slots 140 and 150 to coincide and thereby provide the maximum flow of mud through the nozzle. Conversely, rotation of the disk 146 from the position shown in FIG. 7 in a counterclockwise direction, looking down on the plane of the drawing, reduces the size of the opening as represented by the shaded area 166 until eventually the opening is completely closed off and no flow of mud occurs through the nozzle. When the disk 146 has been rotated to a position relative to the cylindrical member 134 which provides a desired amount of mud spray from the nozzle, the nut 160 is then tightened onto the disk 146 by application of the special tool to the grooved face 164 thereof, to prevent rotation of the disk 146.

Figure 6B:
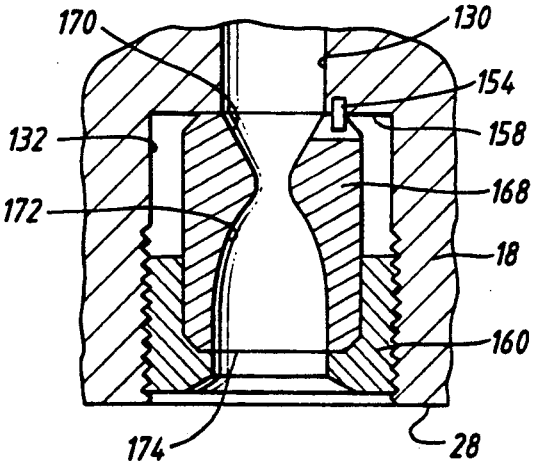
FIG. 6B is a detailed sectional view of an air nozzle according to the invention.

FIG. 6B shows an air nozzle 168 according to the invention. For air drilling, pressurized air is supplied to the drill bit via the drill pipe. In most conventional drill bits, the mud nozzles are removed when air drilling is to be done. Thereafter, the pressurized air is simply blown out of the apertures in which the mud nozzles normally reside. This does not take full advantage of the greatly increased rate of penetration which can be achieved through air drilling.

In accordance with the invention, the mud nozzles 30 are replaced with the air nozzles 168 for air drilling. As shown in FIG. 6B, each air nozzle 168 is mounted in one of the larger apertures 132 using one of the nuts 160. The air nozzle 168 which is of generally cylindrical configuration seats against the bottom surface 158 within the aperture 132 so that a converging portion 170 thereof extends downwardly from the aperture 130 through which the pressurized air is supplied. The converging portion 170 connects with a diverging portion 172 which terminates at a lower end 174 of the nozzle 168 adjacent to the outer opening of the aperture 132.

The converging portion 170 of the nozzle 168 provides substantial acceleration of the pressurized air flowing down the aperture 130. For typical air drilling operations, the air attains a velocity of approximately Mach 1 or greater at the lower end of the converging portion 170. From there the air continues to accelerate as it expands while passing through the diverging portion 172, so that a terminal velocity of Mach 2 is typically achieved. At the same time the supersonic air flow produces a substantial temperature drop at the outside of the nozzle 168, and this tends to freeze the surface of the ground at the bottom of the hole being drilled. In addition to the rate of penetration being significantly greater as a result of the supersonic flow of air, the freezing of the ground surface makes it easier for the cutting teeth 42 and 48 to cut the ground into chips, thereby further improving the drilling operation.

As previously described in connection with FIG. 3, each of the legs 20, 22 and 23 is mounted within one of the keyways 24, 26 and 27 in the body 18 using three of the studs 92 together with three nuts 96 and three safety nuts 98. FIGS. 9 and 10 show the leg mounting arrangement in greater detail. As shown therein, each stud 92 has a threaded forward portion 180 extending from a flange 182 at an intermediate portion of the stud 92 and received within one of the threaded apertures 88. The threaded aperture 88 has an enlarged opening 184 at the outer end thereof for receiving the flange 182.

The stud 92 also has an outer portion 186 on the other side of the flange 182 from the threaded forward portion 180. The outer portion 186 has a portion 188 thereof of given diameter adjacent the flange 182, which portion 188 necks down to a portion 190 of reduced diameter. The portion 190 is threaded. The necking down of the outer portion 186 of the stud 92 facilitate's mounting of the leg 20 on the body 18. Each aperture 94 in the leg has a portion 192 thereof of diameter just slightly greater than the diameter of the portion 188 of the stud 92. The diameter cf the portion 192 of the aperture 94 is substantially larger than the diameter of the portion 190 of the stud 92. This facilitates insertion of the outer portions 186 of the studs 92 into the apertures 94 to initiate mounting of the leg 20 on the body 18. As the leg 20 is moved onto the three studs 92, the portions 192 of the apertures 94 move from the portions 190 of reduced diameter onto the portions 188 of greater diameter of the outer portions 186 of the studs 92 to snugly and precisely position the leg 20 within the keyway 24 in the body 18.

With the leg 20 thus positioned on the studs 92 within the keyway 24 in the body 18, the leg 20 is secured in place by first mounting three of the nuts 96 on the threaded portions 190 of the studs 92. Each of the apertures 94 in the leg 20 has a portion 194 of substantially greater diameter than the portion 192 and joining the portion 192 at a surface 196. The nut 96 is advanced on the threaded part of the portion 190 until the surface 196 is engaged by the nut 96.

To prevent the nuts 96 from loosening through vibration and the like during use of the modular drill bit 10, one of the safety nuts 98 is mounted over each of the nuts 96. The safety nut 98 has a threaded outer surface 198 for engagement with threads within the portion 194 of the aperture 94. The threads of the surface 198 and the portion 194 have a different pitch than the threads of the nut 96 and the threaded portion 190 of the stud 92. Consequently, the nut 96 and the safety nut 98 cannot loosen by rotating together after the safety nut 98 is driven snugly against the nut 96 by insertion of a hex wrench in a hexagonal aperture 200 in an outer surface 202 of the safety nut 98.

Figure 11A:
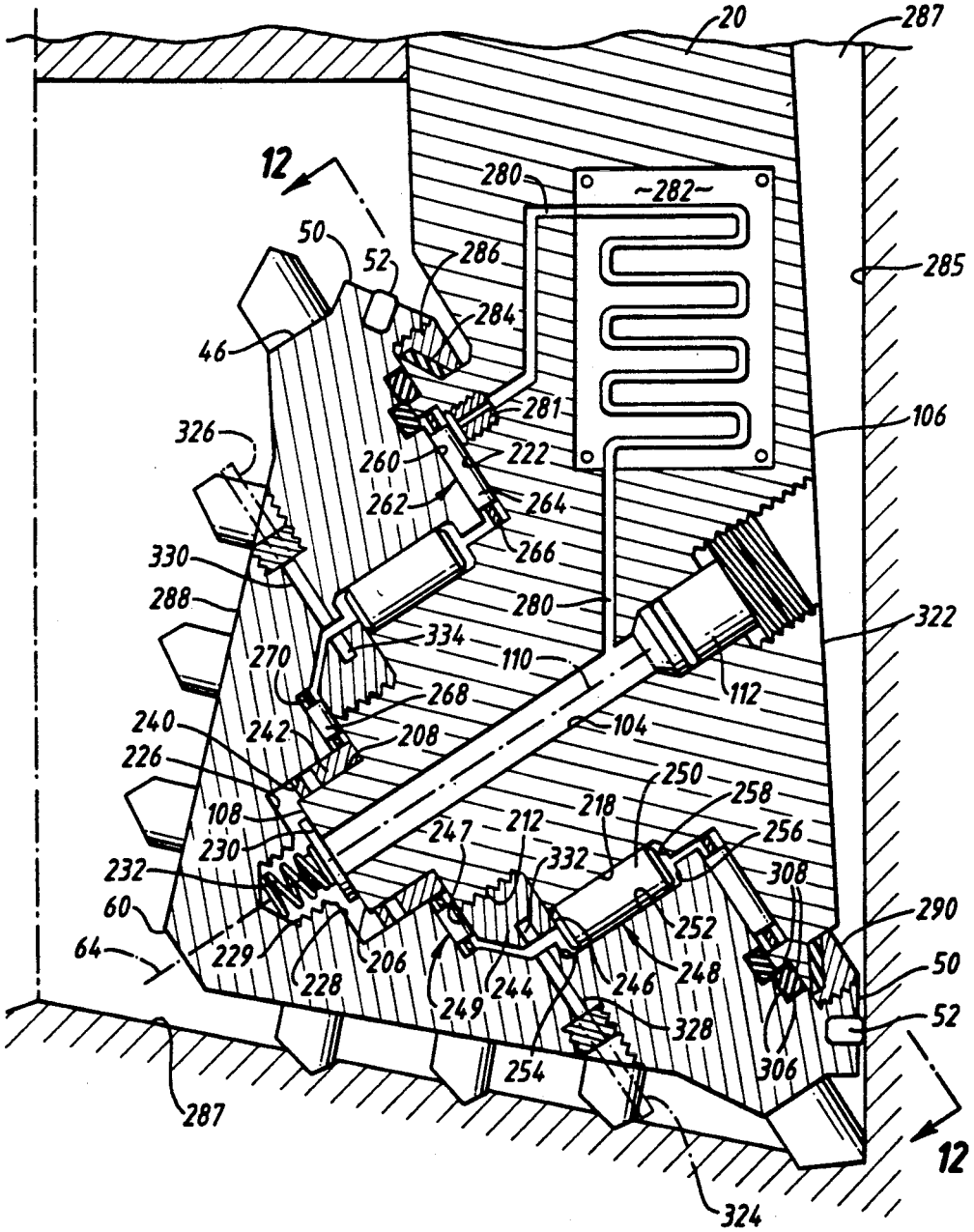
FIG. 11A is a sectional view of a portion of one of the legs and the associated cone of the modular drill bit of FIG. 1, illustrating a bearing and seal arrangement for rotatably mounting the cone on a spindle at the end of the leg as well as apparatus for cooling and recirculating lubricating oil to the cone-leg spindle interface.
Figure 12:
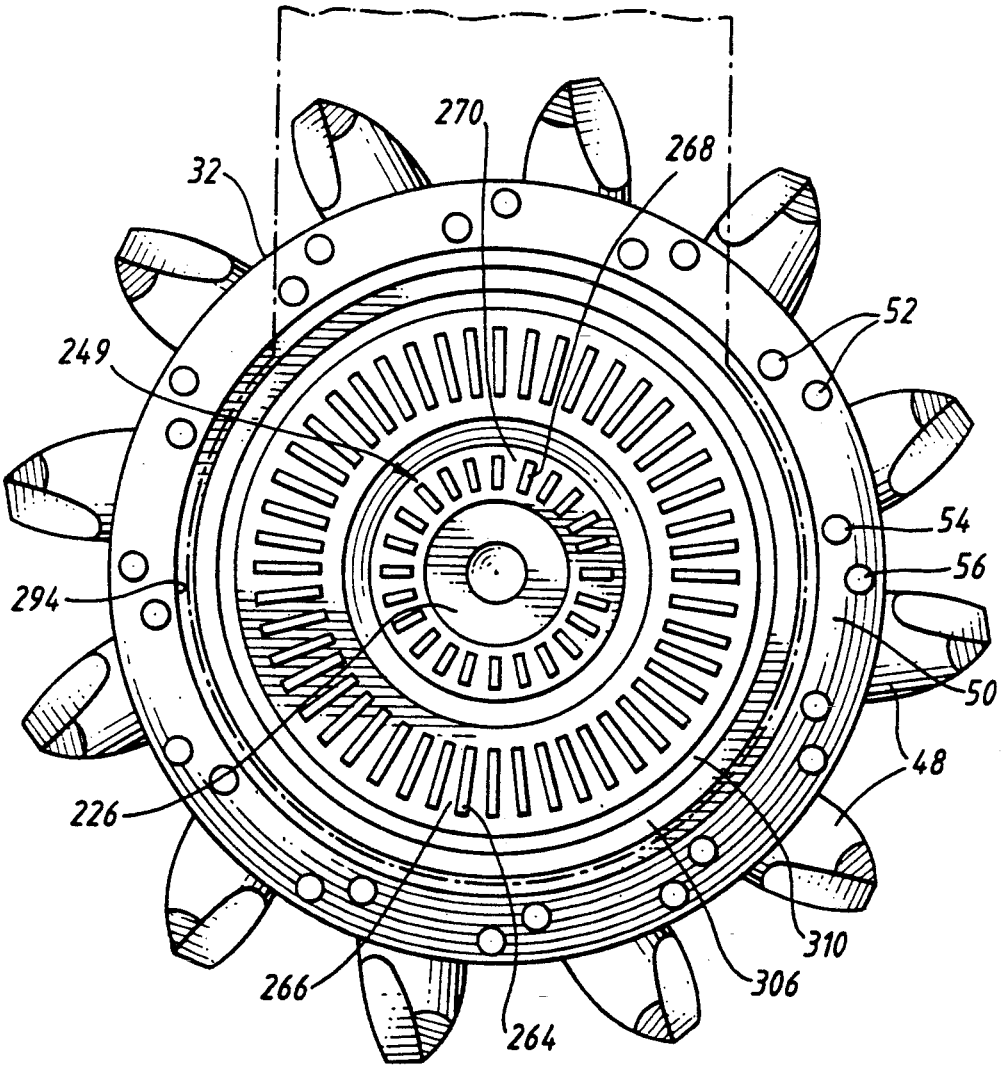
FIG. 12 is a bottom view of the cone of the arrangement of FIG. 11A showing the two roller thrust bearings.

FIG. 11A is a cross-sectional view of the cone 32 mounted on the spindle 100 of the leg 20. FIG. 11B, 11C and 11D show details of some of the components within the cone 32—leg spindle 100 interface of FIG. 11A. FIG. 12 is a bottom view of the cone 32 showing some of the different bearings, seals and other components illustrated in FIG. 11A. The details of the outer surface of the spindle 100 are also shown in FIG. 9.

Figure 9:
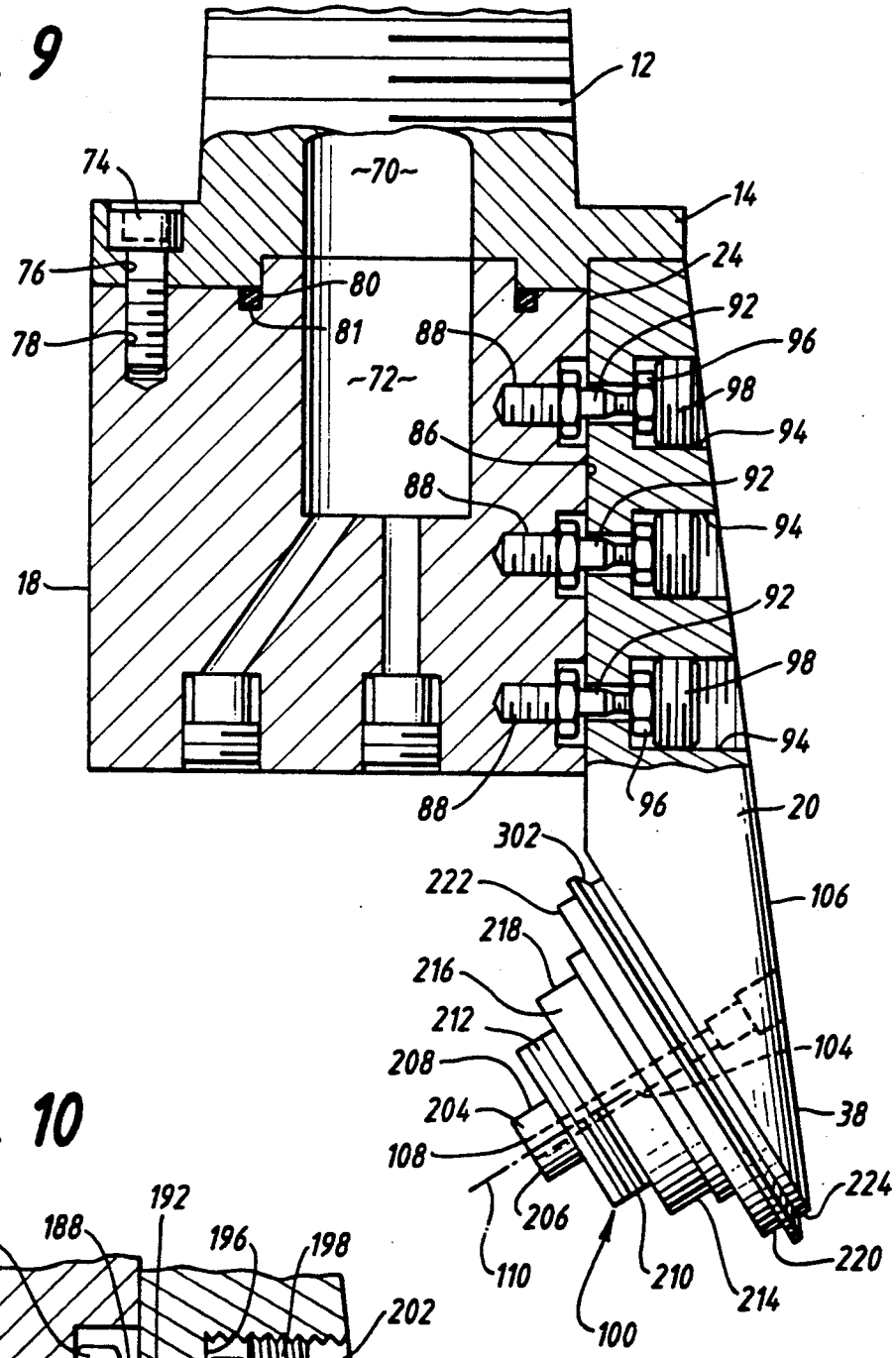
FIG. 9 is a partly broken away sectional view of the body and one of the legs of the modular drill bit of FIG. 1.
Figure 10:
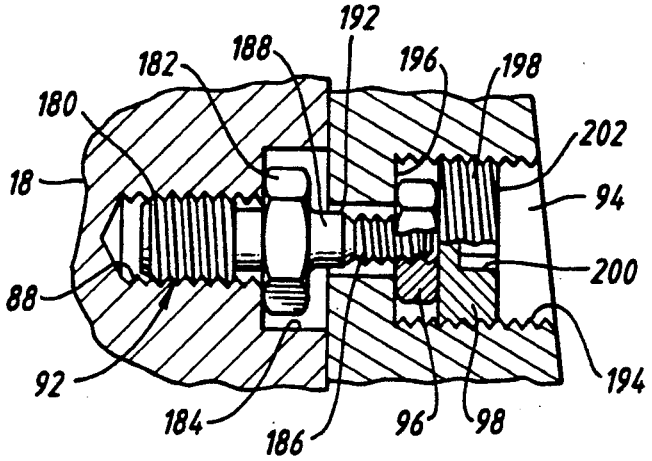
FIG. 10 is an enlarged sectional view of a portion of FIG. 9 illustrating the manner in which threaded studs are used to secure the leg to the body.

Referring first to FIG. 9, the spindle 100 is comprised at the tip thereof of a generally cylindrical portion 204 defining a disk-shaped thrust bearing surface 206 outside of the aperture 104 and forming the surface 108 referred to in FIG. 3. The cylindrical portion 204 also defines a cylindrical bearing surface 208.

Disposed adjacent and behind the cylindrical portion 204 of the spindle 100 is a cylindrical portion 210 of greater diameter than the cylindrical portion 204 and having a generally cylindrical threaded surface 212. A still further cylindrical portion 214 of the spindle 100 located behind and of larger diameter than the cylindrical portion 210 has a cylindrical outer surface 216 defining a race 218 for a main roller bearing as described hereafter.

The spindle 100 has yet another cylindrical portion 220 disposed behind and of larger diameter than the cylindrical portion 214. The cylindrical portion 220 has an annular surface 222 thereof for receiving a thrust bearing as described hereafter. The surface 222 is concentric with and lies in a plane perpendicular to the central axis !!0 of the spindle 100. A generally cylindrical flanged portion 224 located behind and to the outside of the cylindrical portion 220 receives various seals, as described hereafter.

As shown in FIGS. 11A and 12, the cone 32 has a cylindrical cavity 226 located just inside of the tip 60 for receiving the cylindrical portion 204 of the spindle 100. The cavity 226 has a disk-shaped surface 228 at the bottom thereof which is disposed adjacent and generally parallel to the thrust bearing surface 206 of the spindle 100 and which surrounds a central aperture 229 inside the tip 60 of the cone 32.

As shown in FIG. 11A, a beryllium copper washer 230 is disposed between the surfaces 206 and 228 so as to normally reside against the thrust bearing surface 206 under the urging of a steel spring 232 extending into the central aperture 229 from a hub 234 formed on the back side of the washer 230. The washer 230 and the spring 232 rotate with the cone 32, with the result that the washer 230 rotates on the thrust bearing surface 206. As shown in FIG. 11B, a surface 236 of the washer 230 has a spiral groove 238 therein which acts as a valve to pass lubricating oil from the aperture 104 to the space between the surfaces 206 and 228 outside of the washer 230. As described hereafter, lubricating oil is continuously pumped from the aperture 104 to the cone 32-leg spindle 100 interface where it lubricates various bearings described hereafter before being recirculated to the aperture 104. The washer 230 and the included spring 232 function as a shock absorber to absorb thrust loads on the cone in conjunction with thrust bearings which are described hereafter.

The cylindrical cavity 226 in the cone 32 also has a cylindrical bearing surface 240 which is disposed outside of and concentric with the cylindrical bearing surface 208 on the spindle 100. A hollow, generally cylindrical bearing bushing 242 is disposed between the cylindrical bearing surfaces 208 and 240. The bearing bushing 242 is described in detail hereafter in connection with FIGS. 16 and 17.

A lock nut 244 having a threaded inner surface is mounted on the cylindrical threaded surface 212 of the cylindrical portion 210 of the spindle 100. The lock nut 244 has an annular outer edge 246 thereof forming a side of the race 218 of the cylindrical portion 214 of the spindle 100. The lock nut 244 also has an opposite annular outer edge 247 which forms part of a bearing surface for a roller thrust bearing 249 disposed between the cylindrical portion 210 of the spindle and the inside of the cone 32.

The thrust bearing 249 functions in conjunction with a larger thrust bearing described hereafter to enable the cone 32 to withstand substantial thrust loads. The thrust bearing 249 is particularly useful in the case of modular drill bits of smaller diameter such as those on the order of $9\frac{7}{8}''$ diameter or less. Such drill bits of smaller diameter are typically used for deep drilling applications where the thrust loads on the cones of the drill bit can be substantial.

The main bearing for mounting the cone 32 on the spindle 100 is a roller bearing 248. The roller bearing 248 which is of conventional design includes a plurality of cylindrical rollers 250 having the inner halves thereof disposed within the race 218 formed by the cylindrical portion 214 of the spindle 100, such that the race 218 extends essentially to the central axis of each roller 250. At the same time, opposite outer halves of the cylindrical rollers 250 are received within a cylindrical race 252 formed within the cone 32, such that the race 252 extends essentially to the central axis of each roller 250. The cylindrical rollers 250 are disposed around the races 218 and 252 with the central axes thereof generally parallel with the central axes 64 and 110. The races 218 and 252 are concentric with respect to the axes 64 and 110 of the cone 32 and the spindle 100.

The cylindrical race 252 has opposite side surfaces 254 and 256 thereof which are spaced apart by a distance just slightly greater than the length of the cylindrical rollers 250. This confines the cylindrical rollers 250 within the cylindrical race 252 with a relatively close fit preventing any significant movement of the rollers 250 in the direction of the central axis 44 of the cone 32. At the same time the inner race 218 has opposite side surfaces which include a surface 258 in the spindle 100 and an opposite surface formed by the annular outer edge 246 of the lock nut 244. The annular outer edge 246 of the lock nut 244 and the side surface 258 are spaced apart by a distance slightly greater than the length of the cylindrical rollers 250. This permits a limited amount of axial movement of the cone 32 relative to the spindle 100 while at the same time confining the cylindrical rollers 250 within the race 218. This small amount of tolerance allows the cone 32 to undergo small amounts of axial movement relative to the spindle 100 as the steel spring 232 attached to the beryllium copper washer 230 undergoes flexure in response to shock loads.

At the same time, it will be appreciated that the cylindrical rollers 250 of the roller bearing 248 function in combination with the lock nut 244 to prevent unwanted removal of the cone 32 from the spindle 100. With the lock nut 244 mounted on the spindle 100, the annular outer edge 246 thereof combines with the opposite side surface 258 of the race 218 to limit axial movement of the cylindrical rollers 250. At the same time, axial movement of the cylindrical rollers 250 within the cylindrical race 252 in the cone 32 is limited, as previously described. Therefore, the cone 32 cannot be removed from the spindle 100 without removing the lock nut 244 from the spindle 100.

Just outside of the cylindrical race 252 in the cone 32 is an annular surface 260 disposed slightly spaced apart from and generally parallel to the annular surface 222 on the spindle 100. The surface 260 is concentric with and lies in a plane parallel to the central axis 64 of the cone 32. A main thrust bearing 262 which is disposed within such space is of conventional design as shown in FIG. 12 and includes a plurality of rollers 264 within a ring-shaped retainer 266. The main thrust bearing 262 which is located relatively close to the rim 46 at the base of the cone 32 and which is of substantial size functions to absorb most of the thrust load imposed on the cone 32. The thrust bearing 249 absorbs some of the thrust load, and is particularly useful for deep drilling applications where the back-up function of the thrust bearing 249 may be needed. Like the main thrust bearing 262, the thrust bearing 249 is of conventional configuration and is comprised of a plurality of rollers 268 within a ring-shaped retainer 270, as shown in FIG. 12.

In accordance with the invention, the interface between the cone 32 and the spindle 100 of the leg 20 is lubricated using a recirculating lubricating oil. The oil contains solid lubricating particles such as polytetrafluorethylene (Teflon) and molybdenum. One preferred form of the oil comprises an oil mixture in which the particles of polytetrafluorethylene and the particles of molybdenum each comprise approximately 15% of the volume of the oil.

The use of lubricating oil at the cone-leg spindle interface of modular drill bits according to the invention is made possible in part by the pumping action provided by the thrust bearings 249 and 262 shown in FIGS. 11 and 12. Oil which reaches the inner periphery of the thrust bearing 249 is propelled to the outer periphery of the thrust bearing 249 by centrifugal force in conjunction with the rolling action of the rollers 268 within the ring-shaped retainer 270. The oil exits from the region of the outer periphery of the thrust bearing 249 and then flows to the roller bearing 248.

Oil leaving the roller bearing 248 arrives at the inner periphery of the main thrust bearing 262 where it is forced to the outer periphery thereof by the centrifugal action of the rollers 264 within the ring-shaped retainer 266. The main thrust bearing 262 provides the primary pumping action for the oil.

Figure 14:
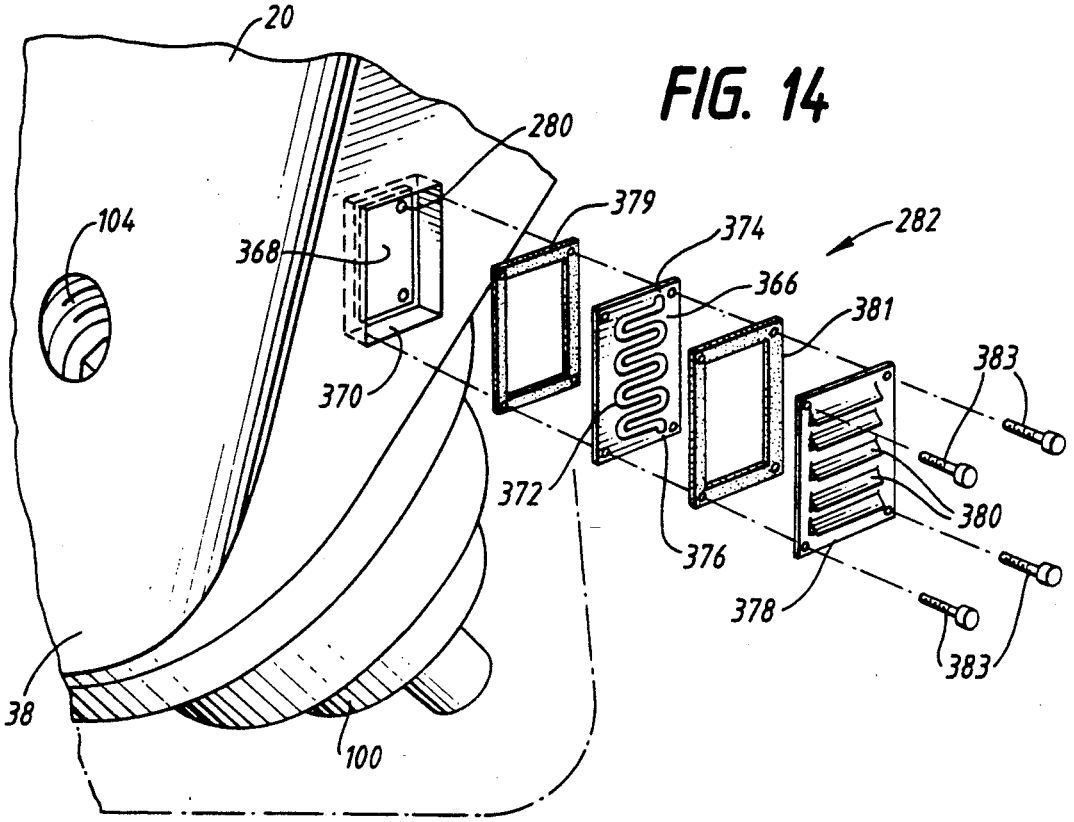
FIG. 14 is an exploded perspective view of the leg of FIG. 11, illustrating a radiator assembly for cooling the recirculating lubricating oil.
Figure 15:
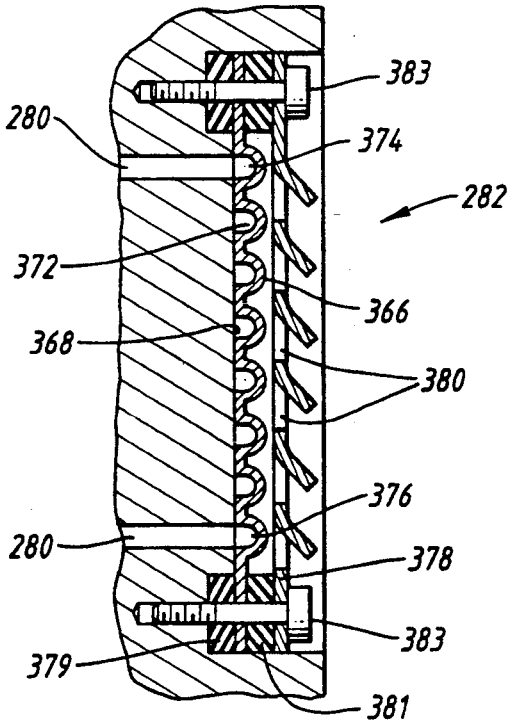
FIG. 15 is a sectional view of the radiator assembly of FIG. 14.

The oil exits from the region of the outer periphery of the main thrust bearing 262 via a passage 280 within the spindle 100 as shown in FIG. 11. A flow restricting bushing 281 at the entrance of the passage 280 helps to absorb flow pulsations resulting from inward movement of the cone 32 in response to the shock loads. The bushing 281 which is made of magnetic material also functions to collect and thereby filter out any metal particles which may accumulate in the oil. The passage 280 extends through a radiator assembly 282 to the aperture 104 within the spindle 100 just downstream of the pressure compensator assembly 112. The radiator assembly 282 which is described in detail hereafter in connection with FIGS. 14 and 15 functions to cool the lubricating oil before recirculating the oil to the cone-leg spindle interface.

The lubricating oil within the aperture 104 in the spindle 100 flows through the groove 238 in the bottom surface 236 in the beryllium copper washer 230 to the outside thereof, in the manner previously described. The oil then flows over the bearing bushing 242, through the thrust bearing 249, and then over the lock nut 244 to the roller bearing 248. At the roller bearing 248, the oil lubricates the cylindrical rollers 250 as it continues to flow outwardly via centrifugal action to the inner periphery of the main thrust bearing 262. The main thrust bearing 262 pumps the lubricating oil to the outer periphery thereof, where the oil exits via the passage 280 in the manner previously described. The thrust bearing 262 provides sufficient pumping action for complete recirculation of the oil without the need for additional pumping means. Additional pumping action is also provided by the thrust bearing 249.

The use of a lubricating oil instead of the more conventional grease, and the recirculating action which is achieved in the manner just described, is highly advantageous from the standpoint of providing continuous and complete lubrication of the various bearings within the cone-leg spindle interface. The application of grease to bearings and other parts, as is typically done in conventional drill bits, often provides less than satisfactory lubrication. Grease which is removed from a critical area because of contamination, due to entry of dirt and debris or for other reasons, is not readily replaced and can lead to rapid failure of the drill bit.

The portion of the cone-leg spindle interface between the outer periphery of the thrust bearing 262 and the outside of the cone 32 is sealed to prevent escape of the lubricating oil from the inside while at the same time preventing entry of sand, dirt, crushed rock and other contaminants from the outside. Such arrangement includes a washer seal 284 disposed inside of a ring-nut 286 secured to the outer periphery of the cone 32.

As previously described, the cone 32 has an extended surface 50 adjacent and on the other side of the outer rim 46 from a generally conical major outer surface 288 of the cone. The ceramic buttons 52 which are mounted in the extended surface 50 are shown in FIG. 11 as well as in FIG. 12. Each ceramic button 52 has a chamfered outer surface which protrudes by a small distance from the extended surface 50 of the cone 32. The chamfered outer surfaces of the ceramic buttons 52 result in the ceramic buttons 52 being subjected principally to compression loads. Because ceramic materials are capable of withstanding substantial compression loads, the ceramic buttons 52 resist damage to or destruction thereof while at the same time providing a backup gauging function as previously described. This is illustrated in FIG. 11 where the ceramic buttons 52 are shown engaging the side wall 285 of a hole 287 being drilled by the modular drill bit 10. In addition, the ceramic buttons 52 function to protect the extended surface 50.

As shown in FIGS. 11A and 11C, the ring-nut 286 which is located just inside of the extended surface 50 has a hardened outer surface 290 thereof which resists wear and damage thereto. At the same time the ring-nut 286 extends over a back portion of the spindle 100 by a sufficient amount to act to retain the cone 32 on the spindle 100 when mounted on the cone 32. The ring-nut 286 has a threaded outer surface 292 which engages a threaded surface 294 on the cone 32 just inside of the extended surface 50 to mount the ring-nut 286 on the cone 32.

The space between the ring-nut 286 and adjacent portions of the spindle 100 is sealed by the washer seal 284. The washer seal 284, which is made of rubber with solid particles of lubricant embedded therein, acts as the primary seal to prevent debris outside of the cone-leg spindle interface from entering such interface.

In addition to the washer seal 284, a pre-seal 296, which is also of generally ring-shaped configuration, is disposed between the cone 32 and the spindle 100 just inside of the washer seal 284. Should the washer seal 284 leak or fail, the pre-seal 296 functions to prevent debris from advancing through the cone-leg spindle interface.

A back-up seal 298 which is also of ring-shaped configuration is disposed between the cone 32 and the spindle 100 just inside of and on the opposite side of the pre-seal 296 from the washer seal 284. The back-up seal 298 functions primarily to prevent lubricating oil at the outer periphery of the thrust bearing 262 from escaping. This confines the oil to flow through the passage 280 and the included radiator assembly 282.

In accordance with the invention, the various seals including the washer seal 284, the pre-seal 296 and the back-up seal 298 are not secured to the adjacent bearing surfaces which they contact. Instead, such seals are free to undergo sliding movement relative to such surfaces, and this tends to promote rotation of the seals relative to both the cone 32 and the spindle 100. Ideally, if the cone 32 rotates on the spindle 100 at a given speed, then each of the seals 284, 296 and 298 rotates relative to the spindle 100 at half the given speed. This means that the cone 32 rotates relative to the seals 284, 296 and 298 at half the given speed.

This "clutch-like" action of the seals 284, 296 and 298 functions to greatly extend the life of the seals. Friction tends to be a function of the square of the relative speed between the seal and the surface against which the seal is sliding. Thus, if a seal is fixedly secured to either the cone 32 or the spindle 100 so that relative movement therebetween is not possible, the seal has to slide against the other member which is not secured thereto at the given speed of rotation of the cone 32. If the cone 32 rotates at a relatively high speed on the spindle 100, this subjects the seal to a substantial amount of friction and resulting heat. Such heat can cause relatively rapid deterioration of the seal, with the result that the life of the seal is greatly shortened.

In the case of the washer seal 284, the pre-seal 296 and the back-up seal 298, such seals are free to undergo sliding movement and therefore to rotate relative to both the cone 32 and the spindle 100. In the case of the washer seal 284, such seal can slide relative to both an inner surface 300 of the ring-nut 286 and an opposite surface 302 formed by the cylindrical flanged portion 224 of the spindle 100. To further facilitate sliding movement of the washer seal 284 relative to the surfaces 300 and 302, the washer seal 284 is formed so as to have a plurality of spaced-apart concentric ribs 304 on opposite surfaces thereof, as shown in FIG. 11D. Coating of the ribs 304 and spaces between the ribs 304 with a non-water soluble grease helps to facilitate sliding movement of the washer seal 284 relative to the opposite surfaces 300 and 302.

As shown in FIGS. 11A and 11C, the pre-seal 296 is disposed between a pair of surfaces 306 at the underside of the cone 32 and a pair of surfaces 308 formed by the cylindrical flanged portion 224 of the spindle 100. The pre-seal 296 is capable of undergoing sliding movement relative to both the surfaces 306 and the surfaces 308 so as to be capable of rotating relative to both the cone 32 and the spindle 100.

In similar fashion, the back-up seal 298 is disposed within and slidable relative to a slot 310 in the underside of the cone 32 and an opposite surface 312 at the outer periphery of the spindle 100 so as to be capable of rotating relative to both the cone 32 and the spindle 100.

In many conventional drill bits, the cones and legs are configured such that the legs are positioned close to the side wall of the hole being drilled. As the legs move around the hole in response to rotation of the body, they frequency scrape the side wall of the hole and are struck by rocks and other protrusions therefrom. This often results in substantial wear and damage and in premature failure of the drill bit. In an effort to prolong the life of such drill bits, the outer edges of the legs are sometimes coated with a hardening material. While such measure tends to reduce the severity of the problem, nevertheless wear and damage continue to occur.

In modular drill bits according to the invention, as best illustrated in FIG. 11A, the cones and legs are configured to dispose the legs in spaced-apart fashion relative to the side wall of the hole. FIG. 11A shows the hole side wall 285 and an adjacent surface 322 of the leg 20. As shown, the entire surface 322 of the leg 20 is spaced apart from the side wall 285. This is made possible in part because of the configuration of the cone 32 with the extended surface 50 in back of the rim 46. The configuration of the cone 32 at the extended surface 50 serves to place the surface 322 of the leg 20 spaced-apart from the side wall 285. The extended surface 50 is protected by the ceramic buttons 52, which also perform a backup gauging function as previously noted. As also previously noted, the ring-nut 286 is provided with the hardened outer surface 290 thereof to resist wear and damage thereto. A portion of the leg 20 adjacent the cone 32 and including the surface 322 is coated with abrasionresistant material as a precautionary measure. Again, however, the surface 322 is isolated from major wear or damage by being spaced apart from the wall 285 in accordance with the invention.

It will be apparent from FIG. 9 as well as FIG. 11A that the spindle 100 at the end 38 of the leg 20 has a generally open face configuration. The various cylindrical portions 204, 210, 214 and 220 are disposed in stepped fashion so as to readily expose the various surfaces including the bearing races thereof to the exterior of the leg 20. This greatly facilitates grinding of the leg 20 to form the spindle 100 thereon. The existence of the aperture 104 between the opposite surfaces 106 and 108 of the leg 20 also facilitates grinding of the leg to form the spindle 100. Holding apparatus can be placed in the opposite ends of the aperture 104 to mount the leg 20. A plurality of legs mounted in this fashion can then be ground to form the spindles 100 using relatively large grinding wheels which greatly speed up the grinding process and make it relatively efficient. In contrast, many prior art drill bits have legs with a non-open face spindle configuration including surfaces at hard to reach locations and angles which often require the use of small grinding wheels when forming the legs. This makes the grinding process far less efficient.

As noted in connection with FIG. 11A, the cone 32 is held on the spindle 100 in a manner which prevent unwanted removal thereof by action of the lock nut 244 with the assistance of the ring-nut 286. Because the lock nut 244 is hidden from the exterior of the cone 32 when the cone is placed on the spindle 100, access must be provided to the lock nut 244 for purposes of mounting the lock nut on the spindle. As shown in FIG. 11A, such access is provided by an opposite pair of pins 324 and 326 inserted through apertures 328 and 330 respectively in opposite sides of the cone 32 and into apertures 332 and 334, respectively, in the lock nut 244. The pins 324 and 326 serve to secure the lock nut 244 within the inside of the cone 32 in order that the lock nut 244 may be screwed onto the spindle 100.

To mount the cone 32 on the spindle 100, the lock nut 244 is secured in place within the cone 32 by the pins 324 and 326. With the beryllium copper washer 230 and included spring 232, the thrust bearing 249, the bearing bushing 242, the rollers 250 of the roller bearing 248, the main thrust bearing 262, the pre-seal 296 and the back-up seal 298 in place within the cone 32, the spindle 100 is inserted into the cone 32 followed by rotation of the leg 20. This advances the lock nut 244 onto the spindle 100. At the same time, the ring-nut 286 is fed onto the cone 32, with the threads thereof having the same pitch as the threads of the lock nut 244. With the washer seal 284 disposed between the ring-nut 286 and the cone 32, the ring-nut 286 is advanced into the cone 32 at the same time as the lock nut 244 is advanced onto the spindle 100. When both the lock nut 244 and the ring-nut 286 are tightly in place, the pins 324 and 326 are removed from the apertures 328, 330, 332 and 334. A pair of set screws with a seal disposed therebetween is then mounted within an enlarged outer threaded portion of each of the apertures 328 and 330 to seal the cone 32-leg spindle 100 interface from the exterior of the cone 32.

Figure 13:
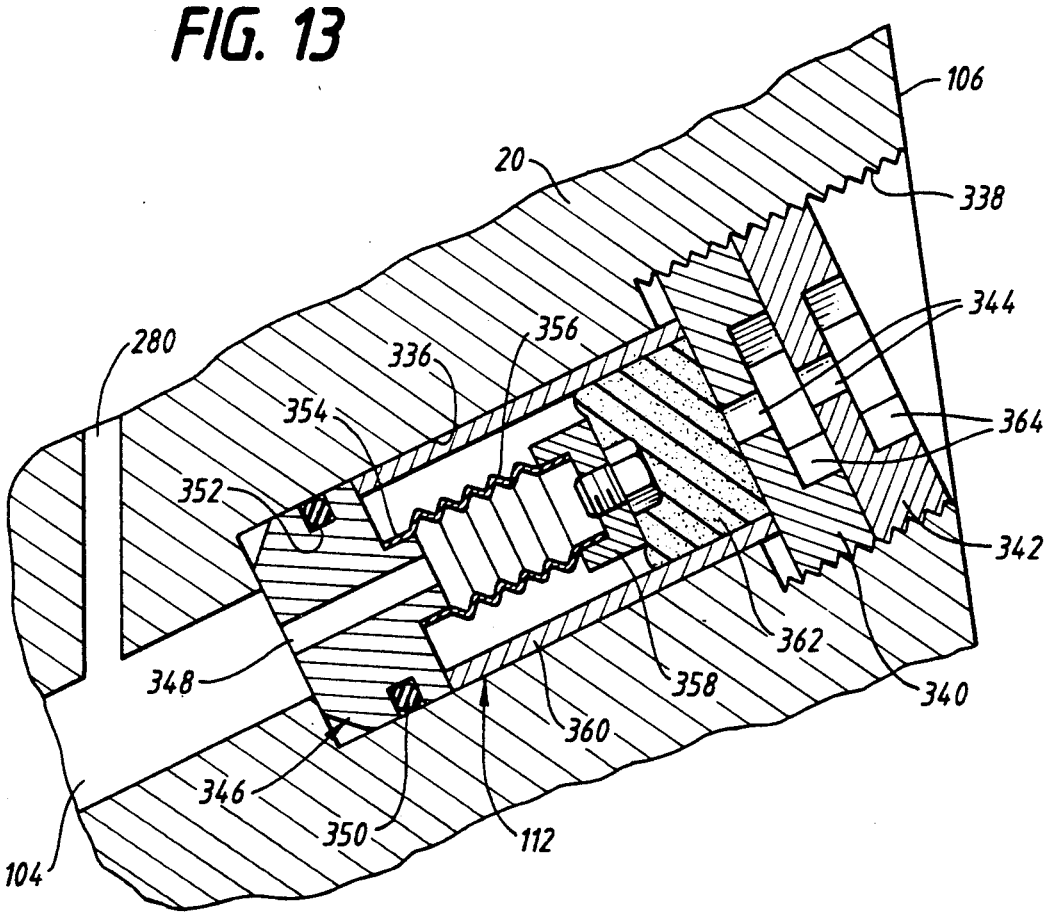
FIG. 13 is a sectional view of a portion of the leg of FIG. 11 illustrating a pressure compensating assembly.

The pressure compensator assembly 112 which is shown in FIGS. 3 and 11A is shown in detail in FIG. 13. As shown in FIG. 13, the aperture 104 extending through the leg 20 between the opposite surfaces 106 and 108 has a first portion 336 of increased diameter and a second portion 338 extending between the first portion 336 and the surface 106 of the leg 20 and having a larger diameter than the first portion 336. The walls of the second portion 338 are threaded to receive the threaded outer surfaces of a pair of set screws 340 and 342 having central passages 344 therethrough.

A plug assembly 346, which is seated within a forward portion of the first portion 336 of the aperture 104 and which has a central aperture 348 therein communicating with the aperture 104, is sealed to the side walls of the first portion 336 by an o-ring 350 disposed within an annular groove 352 in the outer surface of the plug assembly 346. The plug assembly 346 has a central collar 354 thereon for receiving one end of a flexible metallic bellows assembly 356 having a cap 358 enclosing an opposite open end of the bellows assembly 356. The bellows assembly 356 and the cap 358 are disposed within a hollow cylindrical tube 360 disposed within the first portion 336 of the aperture 104. A sponge 362 disposed over the cap 358 within one end of the tube 360 serves as a filter.

Each of the set screws 340 and 342 has a hexagonal recess 364 therein through which the central passage 344 extends. The hexagonal recesses 364 receive a hex wrench to drive the set screws 340 and 342 into the threaded second portion 338 of the aperture 104. The first set screw 340 is driven into the second portion 338 to secure the plug assembly 346 and the tube 360 within the first portion 336. The second set screw 342 is then advanced into the second portion 338 until it is seated against the first set screw 340 to prevent inadvertent loosening of the first set screw 340.

The pressure at the cone-leg spindle interface tends to remain at or close to atmospheric pressure because such interface is sealed. This interface pressure is communicated to the interior of the bellows assembly 356 via the aperture 104 and the central aperture 348 in the plug assembly 346. At the same time, the pressure at the outside of the leg 20 tends to increase with increasing depth of the modular drill bit 10 in the ground. Such pressure is communicated through the central passages 344 in the set screws 340 and 342 to the cap 358 and the exterior of the bellows assembly 356 through the sponge filter 362. The sponge filter 362 prevents contaminants from entering the interior of the tube 360. The bellows assembly 356 expands and contracts in response to different pressure differentials to provide pressure compensation which tends to equalize the pressure at the cone-leg spindle interface with the pressure outside the leg 20 and surrounding the modular drill bit 10.

Such pressure compensation is particularly advantageous in view of the "clutch-like" operation of the washer seal 284, the pre-seal 296 and the back-up seal 298. By equalizing the pressure on the opposite sides of such seals, the seals are free to slide or rotate relative to the opposite surfaces which they contact. Without such pressure compensation, the seals tend to be forced against one set of surfaces so as to undergo little or no sliding motion relative thereto with most or all of the sliding motion occurring relative to the opposite surfaces.

As previously noted in connection with FIG. 11A, the lubricating oil at the cone-leg spindle interface is recirculated through the radiator assembly 282. The radiator assembly 282 is shown in the exploded perspective view of FIG. 14 and in the sectional view of FIG. 15. As shown therein, the passage 280 through the leg 20 extends through a tortuous, zig-zag passage formed by mounting a heat exchange plate 366 on a wall 368 at the back of a recess 370 in the leg 20. The heat exchange plate 366 has a zig-zag groove 372 therein which forms the tortuous, zigzag passage when the plate 366 is mounted on the wall 368.

The heated lubricating oil from the cone-leg spindle interface is applied via the passage 280 to an upper end 374 of the groove 372 within the heat exchange plate 366. The oil flows through the groove 372 and out a lower end 376 of the heat exchange plate 366 for return to the cone-leg spindle interface via the aperture 104. While in the groove 372, the lubricating oil is cooled by the mud being sprayed by the nozzles in the end 28 of the body 18. As the leg 20 rotates about the modular drill bit 10, the radiator assembly 282 which is disposed within the leading edge thereof encounters the sprayed mud. A louver plate 378 which is mounted over the heat exchange plate 366 to protect the heat exchange plate 366 has a plurality of slots 380 therein through which the mud passes. The mud contacts the outer surface of the heat exchange plate 366, and because of its cool temperature provides the desired cooling of the lubricating oil circulating through the groove 372. The lower plate 378 and the heat exchange plate 366, together with rectangular seals 379 and 381 which are disposed on opposite sides of the heat exchange plate 366, are mounted within the recess 370 in the leg 20 by a plurality of screws 383.

As noted in connection with FIG. 11A, the bearing bushing 242 is disposed between the cylindrical bearing surface 208 of the cylindrical portion 204 of the spindle 100 and the cylindrical bearing surface 240 of the cone 32. Enough space exists between the cylindrical bearing surfaces 208 and 240 for the bearing bushing 242 to slide thereon and thereby rotate relative to both the cone 32 and the spindle 100. If the cone 32 rotates on the spindle 100 at a given speed, then ideally the bearing bushing 242 rotates about the spindle 100 at half the given speed.

Unfortunately, there is no guarantee that the bearing bushing 242 will rotate relative to both of the cylindrical bearing surfaces 208 and 240. Due to such things as expansion and contraction as a result of temperature changes, the bearing bushing 242 can freeze or engage one of the cylindrical bearing surfaces 208 and 240 so that no relative rotation therebetween occurs.

Figure 16:
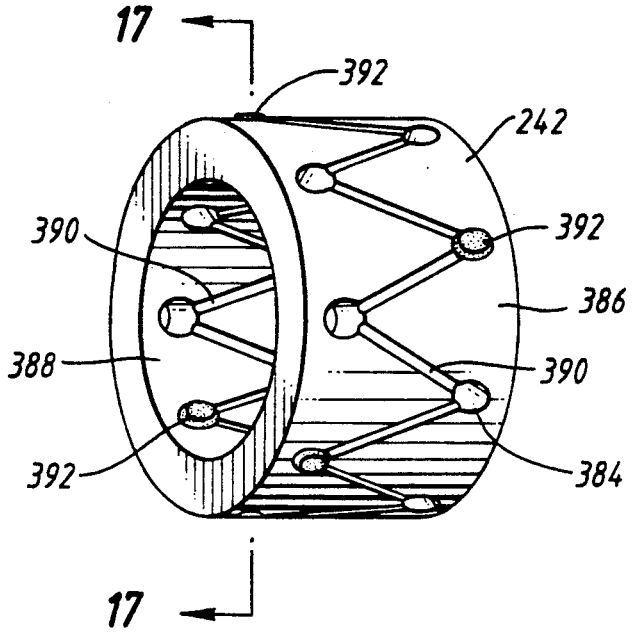
FIG. 16 is a perspective view of a bearing bushing used in the cone-leg spindle interface.
Figure 17:
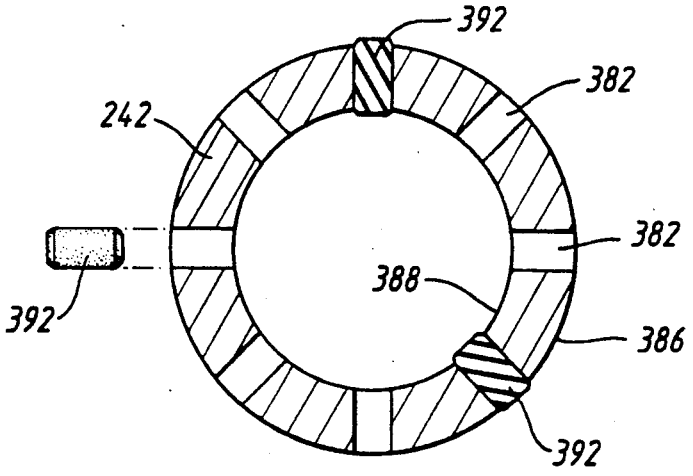
FIG. 17 is a sectional view of the bearing bushing of FIG. 16 taken along the line 17—17 thereof.

To prevent this from happening, the bearing bushing 242, which is shown in detail in FIGS. 16 and 17, is provided with a first row of apertures 382 extending thereabout and a second row of apertures 384 also extending thereabout and staggered relative to the first row of apertures 382. The apertures 382 and 384 extend through the entire thickness of the bearing bushing 242 between an outer surface 286 thereof and an inner surface 388 thereof. Both the outer surface 386 and the inner surface 388 are provided with arrays of grooves 390 which zig-zag back and forth between and connect the apertures 382 and 384 in the different rows thereof.

At least some of the apertures 382 and 384 have rubber rods 392 disposed therein. Two of the rubber rods 392 are shown in the sectional view of FIG. 17. Each rubber rod 392 has a length which is slightly greater than the thickness of the bearing bushing 242. Preferably, the rubber rods 392 are 7–15% longer than the thickness of the bearing bushing 242 so as to protrude from the opposite ends of the apertures 382 and 384. At the same time, the diameter of each rubber rod 392 is 1–5% smaller than the diameter of the apertures 382 and 384 to provide a relatively snug and yet movable fit therein.

The bearing bushing 242 is exposed to the recirculating lubricating oil. The grooves 390 in the outer and inner surfaces 386 and 388 serve to conduct the lubricating oil to the apertures 382 and 384 where the lubricating oil wets the rubber rods 392 to a desired extent. This causes the opposite ends of the rubber rods 392 to slide on the opposite cylindrical bearing surfaces 208 and 240 in controlled fashion so that the bearing bushing 242 rotates relative to both surfaces. The rubber rods 392 are capable of accommodating changing distances between the cylindrical bearing surfaces 208 and 240 while continuing to slide on both such surfaces.

Figure 18A:
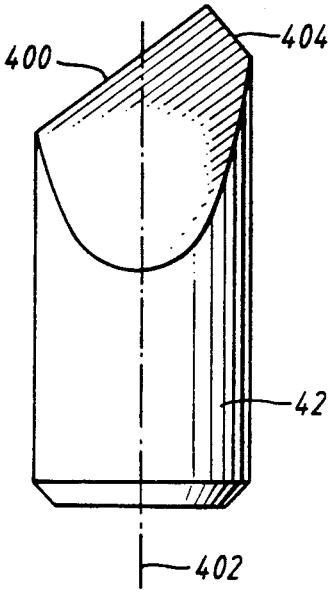
FIG. 18A is a front view of one of the cutting teeth used in the cones of the modular drill bit of FIG. 1.

As previously described, each of the cones 32, 34 and 36 is provided with a plurality of the cutting teeth 42. FIG. 18A shows one of the cutting teeth 42 as formed and prior to being mounted within one of the cones 32, 34 and 36. The cutting tooth 42 and others like it are formed by cutting a bar of relatively hard metal of appropriate composition into a plurality of slugs. Each of the slugs which is of generally cylindrical configuration is then ground at one end thereof to form the cutting tooth 42 shown in FIG. 18. The ground end of the cutting tooth 42 has a chisel or cutting edge 400 which is not perpendicular to, but rather inclined relative to a central axis 402 of the cutting tooth 42.

Figure 19:
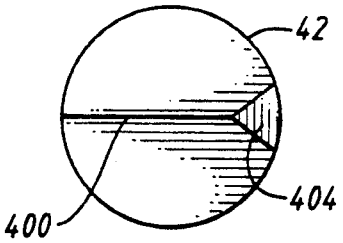
FIG. 19 is a top view of the cutting tooth of FIG. 18A.

FIG. 19 is a top view of the cutting tooth 42 showing the cutting edge 400 thereof. As shown in FIG. 19 as well as in FIG. 18A, a small portion of the upper end of the cutting tooth 42 is ground to form a beveled portion 404 at one end of the cutting edge 400.

While the cutting teeth 48 mounted on the outer rim 46 of the cone are substantially larger than the cutting teeth 42, such cutting teeth 48 are made in essentially the same manner as just described in connection with the cutting tooth 42 of FIGS. 18A and 19. The larger cutting teeth 48, the diameters as well as the lengths of which are substantially larger than the diameters and lengths of the smaller cutting teeth 42, are also mounted on the cone in the same manner as the cutting teeth 42 using the process described hereafter.

Figure 20:
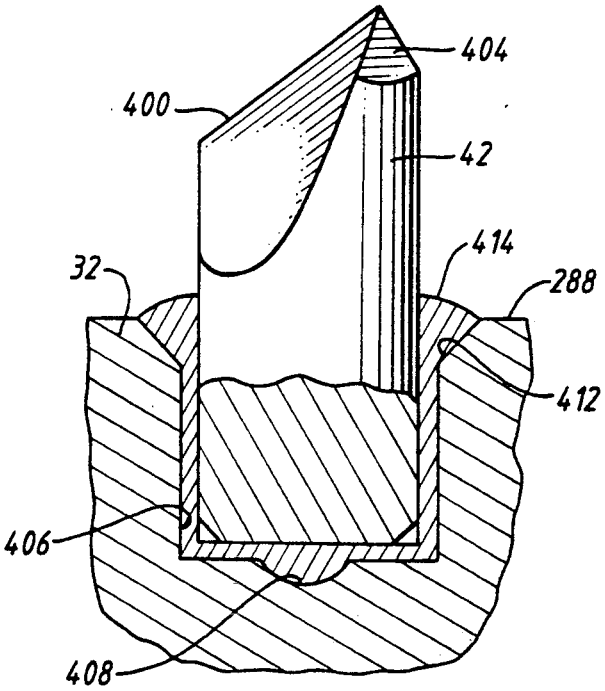
FIG. 20 is a front-side view of the cutting tooth of FIG. 18A, partly in section, and illustrating the manner in which the cutting tooth is mounted on one of the cones.

In preparation for mounting the cutting teeth 42 on the cone, a plurality of holes are drilled in the outer surface of the cone in the locations where the cutting teeth are to be mounted. FIG. 20 shows a small portion of the cone 32 showing one of a plurality of holes 406 formed therein by drilling. The hole 406 has a diameter slightly larger than the diameter of the cutting tooth 42 so as to form a small space between the outer surface of the cutting tooth 42 and the wall of the hole 406. The bottom of the hole 406 has a small reservoir 408 therein which is formed therein during the drilling of the hole 406.

Prior to insertion of the cutting tooth 42 shown in FIGS. 18A and 19 into the hole 406 in the cone 32, the reservoir 408 at the bottom of the hole 406 is filled with a small quantity of bonding material. Examples of appropriate bonding materials include copper paste, nickel paste and other mixtures of brazing metal. Following placement of the bonding material within the reservoir 408, the base of the cutting tooth 402 is inserted into the hole 406. As shown in FIG. 20, the upper end of the hole 406 adjacent the outer surface 288 of the cone 32 has a beveled portion 412. Following placement of the various cutting teeth 42 within holes such as the hole 406 formed in the surface 288 of the cone 32, the cone 32 is heated to a temperature sufficient to melt the bonding material in the reservoir 408 so that the bonding material fills and wets the spaces between the outer surface of the cutting tooth 42 and the walls of the hole 406 including the beveled portion 412. As shown in FIG. 20, a quantity of bonding material 414 fills the spaces between the outer surface of the cutting tooth 42 and the surfaces of the hole 406, including the beveled portion 412. Upon cooling, the cutting tooth 42 is brazed to the cone 32.

The process used to braze the cutting teeth 42 within the holes 406 in the cone 32 can be varied to accommodate the particular bonding material used. In the case of copper paste and nickel paste, the cone 32 with the cutting teeth 42 installed therein is heated in a hydrogen atmosphere to a temperature of approximately 1,750° F., for a period long enough for the bonding material to melt and wet the surfaces of the cutting tooth 42 and the hole 406. As previously noted, the same process is used to mount the larger cutting teeth 48 in holes in the outer rim 46 of the cone 32.

Figure 18B:
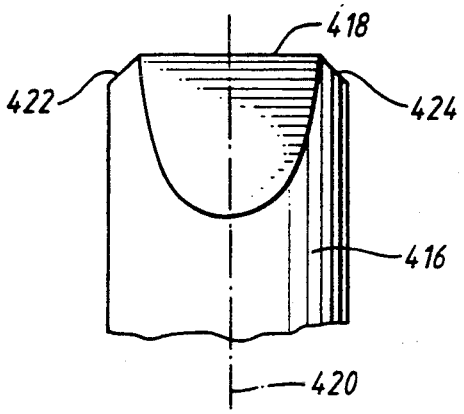
FIG. 18B is a front view of a portion of a cutting tooth similar to the cutting tooth of FIG. 18A but with a differently angled cutting edge.

FIG. 18B shows a cutting tooth 416 which is formed essentially the same way and mounted in a cone in essentially the same way as in the case of the cutting tooth 42 of FIG. 18A using the processes just described. However, in the case of the cutting tooth 416, the upper end thereof is ground to form a chisel or cutting edge 418 which essentially forms a right angle with a central axis 420 of the cutting tooth 416. In the process small bevelled portions 422 and 424 are formed at opposite ends of the cutting edge 418. Although the inclined cutting edge 400 of the cutting tooth 42 of FIG. 18A is preferred for most applications because of its improved cutting action, the cutting tooth 416 of FIG. 18B provides an alternative which may be used for certain applications. For that matter, the cutting edges of the cutting teeth may assume various different inclinations and configurations in accordance with the invention.

The ceramic buttons 52 which are shown in FIGS. 1, 11A and 12 may be mounted on the extended surface 50 of the cone 32 using any appropriate technique such as a press fit within holes drilled in the surface 50. As shown in FIG. 11C, each of the ceramic buttons 52 has a chamfered outer surface 426 which extends by a small distance beyond the extended surface 50 of the cone 32. The chamfered outer surface 426 of the ceramic button 52 assists the ceramic button 52 in withstanding the substantial compression forces to which the ceramic button 52 is subjected, when performing the backup gauging function and in protecting the extended surface 5 by engaging the side wall 285 of the hole 287.

Figure 21A:
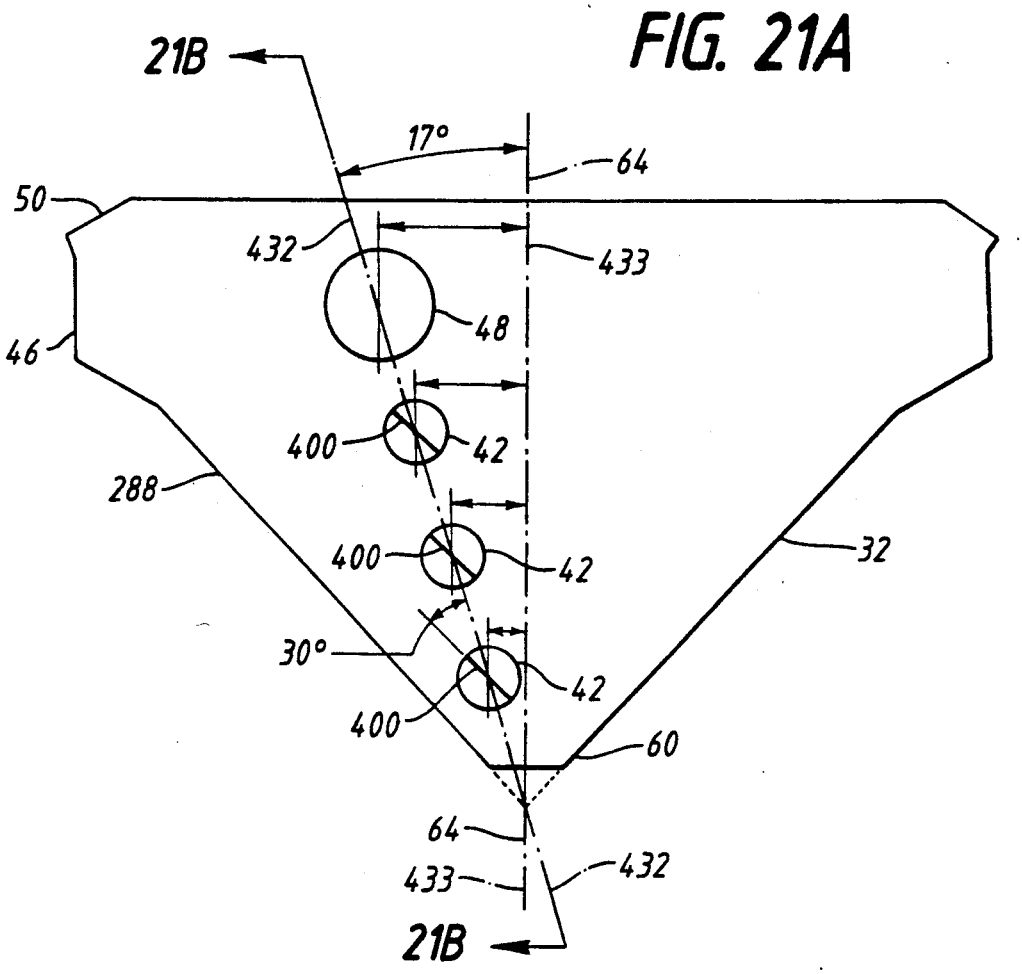
FIGS. 21A and 21B are respectively side and partial sectional views of one of the cones of the modular drill bit of FIG. 1 and illustrating the arrangement of cutting teeth thereon to provide a variable pitch in accordance with the invention.
Figure 21B:
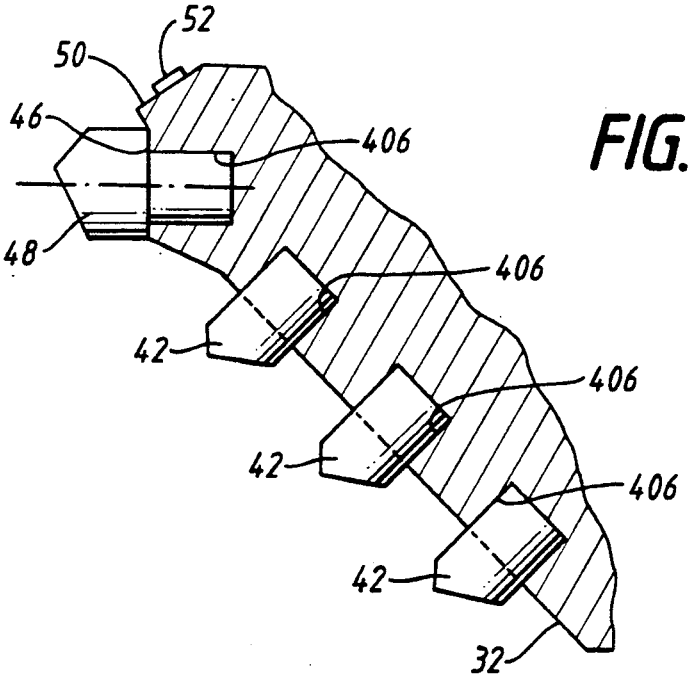

FIGS. 21A and 21B are, respectively, side elevation and sectional views of a cone showing the features of one particular pattern of the cutting teeth 42 and 48 thereon. The cone shown may comprise any of the cones 32, 34 and 36, and is designated as the cone 32 for convenience of reference. As shown in FIG. 21B, the smaller cutting teeth 42 are brazed to the cone 32 within holes 406 in the manner just described. Similarly, the larger cutting teeth 48 are brazed to the cone 32 while disposed in holes 406 within the outer rim 46 of the cone 32.

In accordance with the cutting teeth 42 on the cone surface 288 are arranged to lie along axes which are offset by a small amount from the central axis 64 at the tip 60 of the cone 32. One such axis 432 is shown in FIG. 21A with several of the cutting teeth 42 located therealong as well as one of the large cutting teeth 48 at the rim 46 of the cone 32. It will be seen that the axis 432 is spaced apart from the central axis 64 of the cone 32 by a small distance at the tip 60. In addition, the axis 432 forms an acute angle with an axis 433 which intersects the central axis 64 of the cone 32, so that each cutting tooth 42 and then finally the large cutting tooth 48 is spaced by increasing distances from the axis 433 with increasing distance from the tip 60 of the cone 32. All of the other cutting teeth 42 and 48 are similarly arranged along other axes which are offset and angled in a manner similar to the axis 432, with the result that the teeth 42 and 48 form a variable pitch pattern on the surface of the cone 32. This variable pitch feature which is also true of the patterns of FIGS. 24 and 25 described hereafter provides for greatly improved cutting action through a variety of different hole surface conditions.

In accordance with the invention, the cutting edge 400 of each of the smaller cutting teeth 42 on the surface 288 of the cone 32 forms a like angle with the axis along which the cutting tooth is disposed. In the case of the axis 432 shown in FIG. 21A, each of the cutting edges 400 is offset or inclined relative to the axis 432 by an angle of approximately 30°.

Figure 22A:
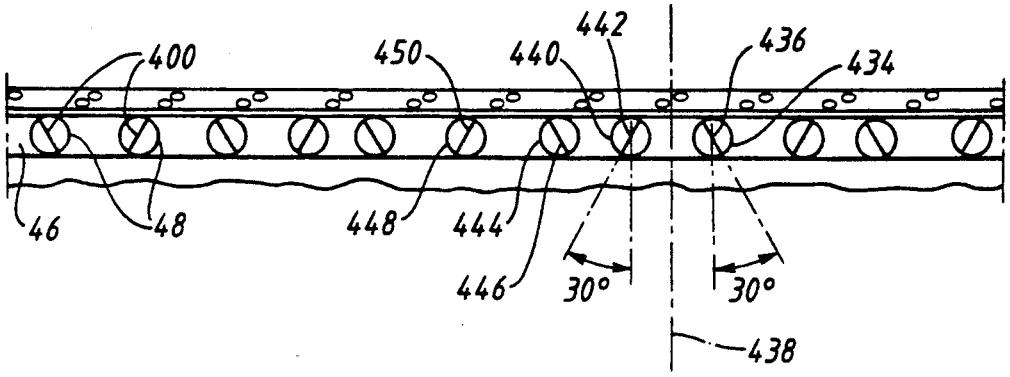
FIG. 22A is a developed view of an outer rim of one of the cones of the modular drill bit of FIG. 1 and illustrating the arrangement of cutting teeth thereon.

FIG. 22A shows a portion of the cone 32 including the entire outer rim 46 thereof which is illustrated in a developed view. The outer rim 46 has the larger cutting teeth 48 mounted therealong. In addition to each of the cutting teeth 48 being inclined in the direction of rotation of the cone 32 relative to radial axes emanating from the central axis 64 of the cone 32 and extending therethrough, the cutting edges 400 of the cutting teeth 48 are inclined in alternating fashion around the rim 46 in accordance with a further feature of the invention. Thus, as shown in FIG. 22A, the cutting teeth 48 include a first such cutting tooth 434 having a cutting edge 436 inclined to the left as viewed in FIG. 22A relative to an axis 438 extending in the direction of the central axis 64 of the cone 32. Conversely, an adjacent cutting tooth 440 to the immediate left of the cutting tooth 434 has a cutting edge 442 thereof inclined to the right relative to the axis 438 as viewed in FIG. 22. The next cutting tooth 444 to the immediate left of the cutting tooth 440 has a cutting edge 446 inclined to the left relative to the axis 438 as viewed in FIG. 22, in the manner of the cutting edge 436 of the first cutting tooth 434. Likewise, a cutting tooth 448 to the immediate left of the cutting tooth 444 has a cutting edge 450 inclined to the right relative to the axis 438 in the manner of the cutting edge 442 of the cutting tooth 440. The cutting edges of the various large cutting teeth 48 alternate in direction in this fashion around the entire outer rim 46 of the cone 32.

Figure 22B:
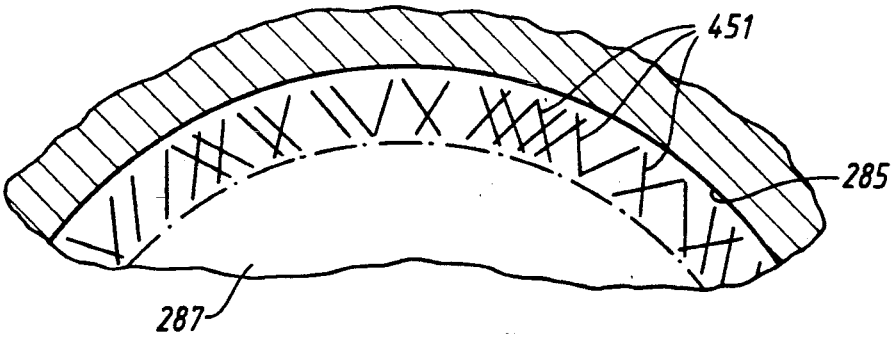
FIG. 22B is a plan view of a portion of the bottom of a hole being by the modular drill bit of FIG. 1 and illustrating the manner in which the cutting edges of the cutting teeth shown in FIG. 22A enter the ground in a criss-crossing pattern.

The alternating cutting edges 400 of the cutting teeth 48 mounted on the rim 46 provide an advantageous criss-cross cutting configuration as the teeth 48 perform the primary gauging function at the outer periphery of the bottom surface of the hole being drilled. This is illustrated in FIG. 22B which shows a portion of the bottom surface 287 of the hole adjacent the outer wall 285. As the edges 400 of the teeth 48 enter the surface 287 with a series of alternating cuts 451, piles of loosened soil 453 are formed, as shown. With repeated movement of the teeth 48 over the outer periphery of the bottom surface 287, the alternating angles of the cutting edges 400 repeatedly cut into the surface in a manner which penetrates and breaks up the surface material in a manner far superior to the results obtained with cutting edges of like orientation on the primary gauging teeth.

Figure 23A:
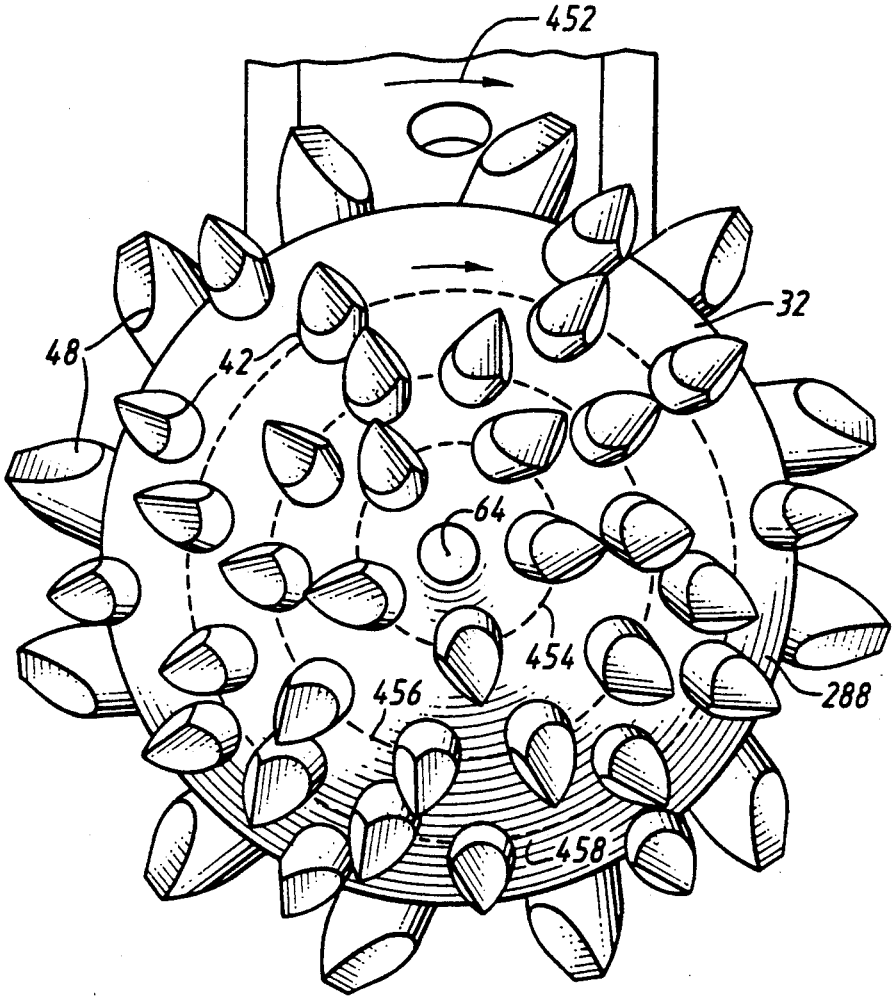
FIG. 23A is a plan view of one of the cones of the modular drill bit of FIG. 1 illustrating an arrangement of cutting teeth thereon in a first pattern according to the invention.

FIG. 23A is a more complete showing of the cone 32 which rotates in a direction shown by an arrow 452. According to a further feature of the invention utilized in the cutting tooth pattern of FIG. 23, the smaller cutting teeth 42 on the generally conical major outer surface 288 of the cone 32 are located around circles which are non-concentric with respect to the central axis 64 of the cone 32 and which lie in planes forming other than right angles with the central axis 64. Moreover, each such circle is non-concentric with respect to all other circles in which the cutting teeth 42 lie and forms a different angle with respect to the central axis 64. Several such circles 454, 456 and 458 are shown in dotted outline in FIG. 23. The smallest such circle 454, which is closest to but non-concentric relative to the central axis 64 of the cone 32, contains five of the cutting teeth 42. The next such circle 456 which is considerably larger than the circle 454, and which is non-concentric with respect to both the circle 454 and the central axis 64, includes ten of the cutting teeth 42. The third such circle 458 which is larger than the circle 456, and which is non-concentric with respect to the circles 454 and 456 as well as the central axis 64, includes eleven of the cutting teeth 42. Other ones of the cutting teeth 42 on the cone 32 lie within still other circles which are not identified in FIG. 23.

Figure 23B:
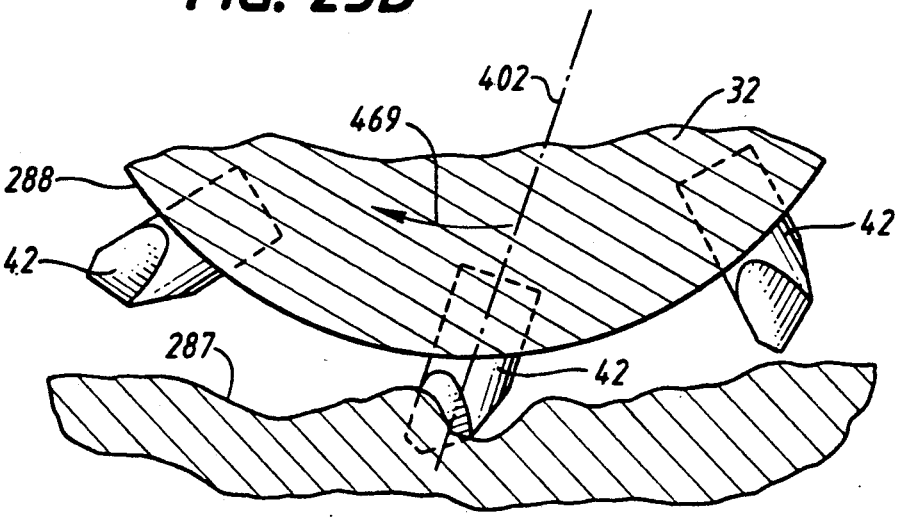
FIG. 23B is a schematic view of a portion of the cone of FIG. 23A relative to the ground surface and illustrating the manner in which the angled cutting teeth of the cone enter the ground.

In accordance with the invention, all of the cutting teeth 42 and 48 are offset or inclined in the direction of rotation of the cone 32. This is shown in FIG. 23B. Thus, in the case of the larger cutting teeth 48 mounted at the outer rim 46 in FIG. 23A, such cutting teeth 48 are inclined at acute angles relative to axes extending radially from the central axis 64 of the cone 32 to the locations of the cutting teeth 48 and perpendicular to the surface of the rim 46 at these locations. The inclination of the cutting teeth 48 is in the direction of rotation of the cone 32 which is represented by the curved arrow 452 in FIG. 23A.

The smaller cutting teeth 42 disposed on the generally conical major outer surface 288 of the cone 32 are also inclined in the direction of rotation of the cone 32 represented by the curved arrow 452. In the case of each of the cutting teeth 42, such tooth is inclined so as to form an acute angle relative to an axis perpendicular to the surface 288 at the location of the tooth. Stated in another way, each cutting tooth 42 is inclined by a relative small acute angle relative to a straight-up position on the surface 288 of the cone 32 in the direction of rotation of the cone 32.

Referring again to FIG. 23B, this shows three of the cutting teeth 42 on the outer conical surface 288 of the cone 32. The direction of cone rotation is shown by an arrow 469. Because the teeth 42 (and the larger cutting teeth 48) are inclined in the direction of cone rotation so as to be at other than right angles with the surface of the cone at their location, the teeth 42 penetrate the hole surface 287 more directly rather than sideways. This minimizes bending, breaking or other damage to the teeth 42, while at the same time penetrating the ground in a more effective fashion.

Figure 24:
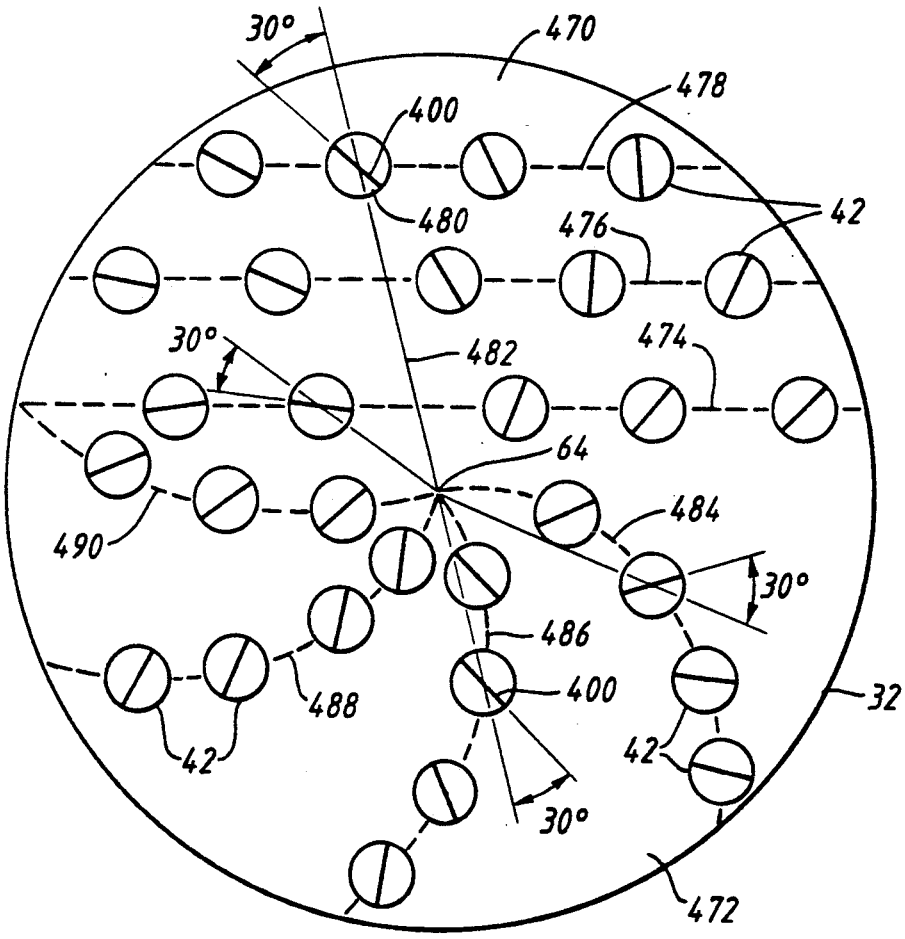
FIG. 24 is a plan view of one of the cones of the modular drill b of FIG. 1 illustrating an arrangement of cutting teeth thereon in a second pattern according to the invention.

FIG. 24 is a plan view of the cone 32 with the smaller cutting teeth 42 arranged in a second pattern according to the invention. In the second pattern illustrated by FIG. 24, the cutting teeth 48 on a first half 470 of the cone 32 corresponding to the upper half shown in FIG. 24 are arranged differently from an opposite second half 472 corresponding to the lower half shown in FIG. 24. In the first half 470, the various cutting teeth 42 are arranged along a plurality of generally parallel lines, with three such lines 474, 476 and 478 being shown in dotted fashion in FIG. 24. Moreover, each of the cutting teeth 42 has the cutting edge 400 thereof inclined at a like angle relative to an axis extending through the tooth from the central axis 64, as illustrated for example by a cutting tooth 480 disposed along an axis 482 extending therethrough from the central axis 64. In the case of each of the cutting teeth 42 shown in FIG. 24, including the cutting tooth 480, the cutting edge 400 thereof is inclined at a like angle, namely approximately 30°, relative to axes extending therethrough from the central axis 64 of the cone 32, such as the axis 482 in the case of the tooth 480.

In the second half 472 of the cone 32 as illustrated in FIG. 24, the cutting teeth 42 are arranged in different fashion. As shown in FIG. 24, the cutting teeth 42 are arranged along curved lines emanating from the central axis 64, as represented by four different curves 484, 486, 488 and 490 shown in dotted outline in FIG. 24. Again, each of the cutting teeth 42 disposed along one of the curves 484, 486, 488 and 490 has the cutting edge 400 thereof inclined at an angle of approximately 30° relative to an axis extending through the cutting tooth from the central axis 64.

Figure 25:
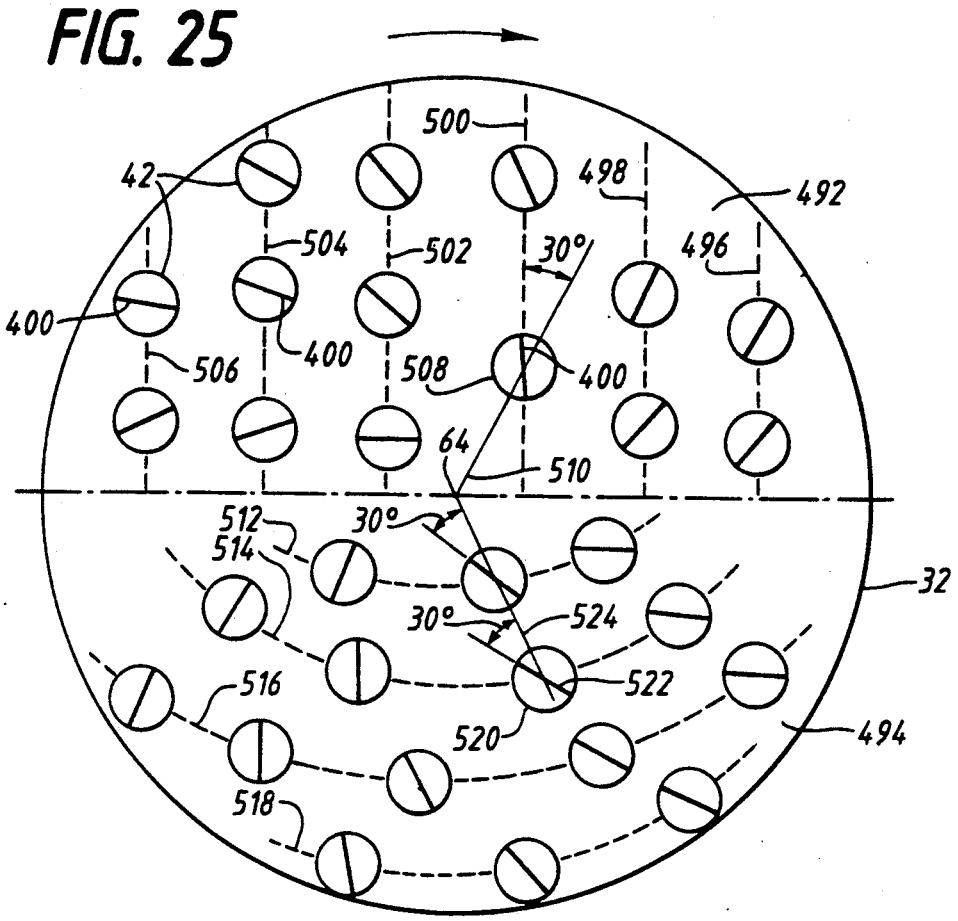
FIG. 25 is a plan view of one of the cones of the modular drill bit of FIG. 1 illustrating the arrangement of cutting teeth thereon in a third pattern according to the invention.

FIG. 25 is a plan view of the cone 32 with the smaller cutting teeth 42 arranged in a third pattern according to the invention. In the third pattern illustrated by FIG. 25, the cutting teeth 48 on a first half 492 of the cone 32 corresponding to the upper half shown in FIG. 25 are arranged differently from an opposite second half 494 corresponding to the lower half shown in FIG. 25. In the first half 492, the various cutting teeth 42 are arranged along a plurality of generally parallel lines extending in common directions away from the second half 494. Six such lines 496, 498, 500, 502, 504 and 506 are shown in dotted fashion in FIG. 25. Moreover, each of the cutting teeth 42 has the cutting edge 400 thereof inclined at a like angle relative to an axis extending through the tooth from the central axis 64, as illustrated for example by a cutting tooth 508 disposed along an axis 510 extending therethrough from the central axis 64. In the case of each of the cutting teeth 48 shown in FIG. 25, including the cutting tooth 508, the cutting edge 400 thereof is inclined at a like angle, namely approximately 30°, relative to axes extending therethrough from the central axis 64 of the cone 32, such as the axis 510 in the case of the cutting tooth 508.

In the second half 494 of the cone 32, as illustrated in FIG. 25, the cutting teeth 42 are arranged in different fashion. As shown in FIG. 25, the cutting teeth 42 are arranged along curved lines. Four such curved lines 512, 514, 516 and 518 are shown in dotted outline in FIG. 25. Again, each of the cutting teeth 42 disposed along one of the curved lines 512, 514, 516 and 518 has the cutting edge 400 thereof inclined at an angle of approximately 30° relative to an axis extending through the cutting tooth from the central axis 64. This is illustrated, for example, by a cutting tooth 520, the cutting edge 522 of which forms an angle of approximately 30° with an axis 524 extending through the cutting tooth 520 from the central axis 64.

As previously described in connection with FIGS. 21A and 21B, the cutting teeth 42 on cones according to the invention are disposed in variable pitch fashion such that they lie along axes which are offset from the central axis of the cone at the tip of the cone. Such variable pitch configuration provides improved drilling performance, and is particularly advantageous when drilling through different surface conditions. The variable pitch feature is further enhanced by disposing different numbers of cutting teeth on opposite halves of each cone, as previously described in connection with FIGS. 24 and 25. This asymmetrical disposition of the cutting teeth provides a variable pitch pattern which is advantageous in preventing unwanted resonance. The patterns of FIGS. 24 and 25 also dispose the cutting teeth thereof on axes offset from the cone's central axis at the tip of the cone in the manner described in connection with FIGS. 21A and 21B.

As previously described in connection with FIG. 23B, both the smaller cutting teeth 42 and the larger cutting teeth 48 are inclined in the direction of rotation of the cone to improve penetration of the hole surface while at the same time minimizing damage to the cutting teeth. This feature is also present in the patterns of FIGS. 24 and 25, wherein all of the cutting teeth are inclined in the direction of rotation of the cones shown therein.

In accordance with a further feature of the invention, the various patterns of the cutting teeth 42 on the cones 32, 34 and 36 are arranged such that the distance of each cutting tooth 42 from the tip of the cone on which it is mounted is different. This is accomplished by drilling each hole in which one of the cutting teeth 42 is to be mounted at a different distance from the center of the cone compared to the distances of all of the holes in the three cones of the drill bit. At the same time, the other rules for tooth placement previously discussed are observed so that the other features in accordance with the invention are realized as well. Location of each cutting tooth 42 of the drill bit at a different distance from the center of its cone ensures that the entire surface area of the ground 287 at the bottom of the hole is broken up by the cutting teeth. Indeed, each of the three cones 32, 34 and 36 is capable of breaking up substantially the entire ground surface because of the location of the cutting teeth 42 thereon at different distances from the cone tip and in a manner which eliminates the large spaces between rows or groups of teeth that are often present in the cones of prior art drill bits. This feature is utilized in all patterns according to the invention including the patterns of FIGS. 23A, 24 and 25.

In a further feature according to the invention, each of the three cones 32, 34 and 36 of the modular drill bit 10 is provided with the same number of cutting teeth 42. Thus, in spite of the different numbers of cutting teeth on opposite halves of the cones, as well as other considerations observed in achieving the various other features, providing of the three cones with the same number of teeth has been found to result in essentially the same torque at each cone. Consequently, the rotational wobbling motion common in many prior art drill bits is minimized or eliminated.

Figure 26:
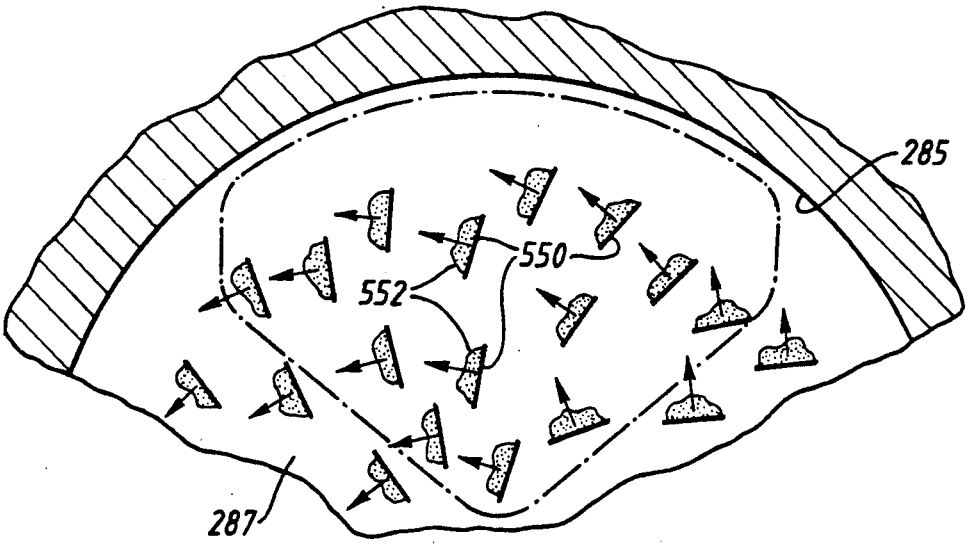
FIG. 26 is a plan view of a portion of the bottom of a hole being drilled by the modular drill bit of FIG. 1 and illustrating the manner in which the cutting edges of the cutting teeth provide scooping to the side as they enter the ground.

A still further feature according to the invention is shown in FIG. 26. As previously discussed in connection with FIGS. 21A, 24 and 25, the cutting edge 400 of each cutting tooth 42 is inclined at an acute angle relative to an axis extending through the cutting tooth from the center of the cone. In such examples, the cutting edges 400 are inclined at angles of approximately 30° relative to such axes. Moreoever, the inclination of each cutting edge 400 with respect to such axes is in the direction of rotation of the cone.

FIG. 26 which shows a portion of the bottom surface 287 of the hole adjacent the wall 285 illustrates the cutting action produced when all of the cutting edges are angled in this fashion. The cutting action produced by the larger cutting teeth 48 at the outer rim 46 of each cone as shown in FIG. 22B is eliminated from the showing of FIG. 26 for simplicity of illustration. As each cone such as the cone 32 rotates over the hole bottom surface 287, the cutting edges 400 of the teeth 42 penetrate the surface 287 to create a plurality of angled cuts 550. Adjacent each cut 550 and on the side thereof closest to the hole wall 285 is a pile of dirt or debris 552 which has been broken and pushed up by the cutting teeth 42. This sidescrapping action is advantageous, particularly from the standpoint of quickly removing the loose material from the surface 287 of the hole. The sprayed mud carries the dirt and other material to the region of the outer wall 285 of the hole where such material floats upwardly over the outside of the drill pipe for removal. Therefore, by angling each cutting edge 400 in similar fashion, as in the case of each of the patterns of FIGS. 21A, 24 and 25, this advantage is realized in all of the patterns according to the invention.

While the invention has been particularly shown and described with reference to preferred embodiments thereof, it will be understood by those skilled in the art that various changes in form and details may be made therein without departing from the spirit and scope of the invention.

What is claimed is:

1. Apparatus for use in a drill bit comprising the combination of a leg having a cone-mounting spindle, a cone disposed over the spindle of the leg, a roller bearing disposed between the cone and the spindle, the roller bearing being operative to prevent the cone from separating from the spindle, and the cone and the spindle each having races therein for receiving rollers of the roller bearing including opposite ends of the rollers, and a lock nut mounted on the spindle of the leg, the lock nut forming an end of the race in the spindle.

2. Apparatus for use in a drill bit comprising the combination of a leg having a cone-mounting spindle, a cone disposed over the spindle of the leg, a roller bearing disposed between the cone and the spindle, the roller bearing being operative to prevent the cone from separating from the spindle, the cone and the spindle each having races therein for receiving rollers of the roller bearing including opposite ends of the rollers, the races in the cone and the spindle each receiving approximately one-half the diameter of each roller of the roller bearing, and the rollers of the roller bearing having central axes, and a lock nut mounted on the spindle of the leg at one end of the roller bearing and having an outer diameter approximately coincident with the central axes of the rollers of the roller bearing.

3. Apparatus for use in a drill bit comprising the combination of a leg having a cone-mounting spindle, a cone disposed over the spindle of the leg, and a washer and attached spring disposed between the cone and the spindle and operative to absorb shock loads on the cone, the washer comprising a beryllium copper disk having a hub thereon for receiving the spring, and the spring being made of steel.

4. Apparatus for use in a drill bit comprising the combination of a leg having a cone-mounting spindle, a cone disposed over the spindle of the leg, and a washer and attached spring disposed between the cone and the spindle and operative to absorb shock loads on the cone, the spindle having a bearing surface with an aperture thereon for delivering lubricating oil, the spring normally forcing the washer against the bearing surface, and the washer having a surface adjacent the bearing surface which has a spiral groove therein for feeding lubricating oil from the aperture in controlled fashion.

5. Apparatus for use in a drill bit comprising the combination of a leg having a cone-mounting spindle, a cone disposed over the spindle of the leg, and a washer and attached spring disposed between the cone and the spindle and operative to absorb shock loads on the cone, the spindle having a bearing surface thereon for receiving the washer and the cone having an aperture on an inside thereof for receiving the spring therein.

6. Apparatus for use in a drill bit comprising the combination of:

a leg;

a cone rotatably mounted on the leg;

a roller thrust bearing disposed between the cone and the leg, the leg and the cone forming an interface therebetween terminating at an outer periphery of the cone and the roller thrust bearing being located within the interface adjacent the outer periphery of the cone; and a second roller thrust bearing located within the interface and inside of the first-mentioned roller thrust bearing.

7. Apparatus for use in a drill bit comprising the combination of:

a leg;

a cone rotatably mounted on the leg;

a roller thrust bearing disposed between the cone and the leg, the leg and the cone forming an interface therebetween terminating at an outer located within the interface adjacent the outer periphery of the cone; and a main bearing disposed between the cone and the leg, and wherein the roller thrust bearing is disposed outside of the main bearing.

8. Apparatus in accordance with claim 7, further including a second roller thrust bearing disposed between the cone and the leg inside of the main bearing.

9. Apparatus for use in a drill bit comprising the combination of:

a leg;

a cone rotatably mounted on the leg; and a roller thrust bearing disposed between the cone and the leg, the leg and the cone forming an interface therebetween terminating at an outer periphery of the cone and the roller thrust bearing being located within the interface adjacent the outer periphery of the cone, the roller thrust bearing including a generally ring-shaped bearing retainer having a plurality of radial slots therein and a plurality of rollers disposed within the radial slots.

10. Apparatus in accordance with claim 9, further including means for introducing a quantity of lubricating oil at the roller thrust bearing, and wherein the radial slots and the rollers act to distribute the lubricating oil throughout the roller thrust bearing.

11. Apparatus in accordance with claim 10, further including a seal disposed between the leg and the cone outside of the roller thrust bearing, the seal acting to confine the lubricating oil to the region of the roller thrust bearing.

12. Apparatus in accordance with claim 11, wherein the seal is of generally ring-shaped configuration.

13. Apparatus for use in a drill bit comprising the combination of:

a leg terminating in a spindle, the spindle having a central axis and having a circular bearing race concentrically disposed relative to the central axis and having a back wall lying in a plane generally normal to the central axis;

a cone rotatably mounted on the spindle and having a central axis of rotation generally coincident with the central axis of the spindle and a bearing race concentrically disposed relative to the central axis of the cone and having a wall lying in a plane generally normal to the central axis of the cone, the wall of the bearing race of the cone being spaced apart from and generally parallel to the back wall of the bearing race of the spindle and;

a thrust bearing mounted within the bearing race of the spindle and the bearing race of the cone and extending between the back wall of the bearing race of the spindle and the wall of the bearing race of the cone, the cone having an outer surface which terminates in an outer periphery just outside of the thrust bearing.

14. Apparatus for use in a drill bit comprising the combination of:

a leg terminating in a spindle, the spindle having a central axis and having a circular bearing race concentrically disposed relative to the central axis and having a back wall lying in a plane generally normal to the central axis;

a cone rotatably mounted on the spindle and having a central axis of rotation generally coincident with the central axis of the spindle and a bearing race concentrically disposed relative to the central axis of the cone and having a wall lying in a plane generally normal to the central axis of the cone, the wall of the bearing race of the cone being spaced apart from and generally parallel to the back wall of the bearing race of the spindle; and a thrust bearing mounted within the bearing race of the spindle and the bearing race of the cone and extending between the back wall of the bearing race of the spindle and the wall of the bearing race of the cone, the thrust bearing includes a ring-shaped retainer having an array of radial slots therein and a plurality of cylindrical rollers disposed in the radial slots.

15. Apparatus for use in a drill bit comprising the combination of:

a leg terminating in a spindle, the spindle having a central axis and having a circular bearing race concentrically disposed relative to the central axis and having a back wall lying in a plane generally normally to the central axis;

a cone rotatably mounted on the spindle and having a central axis of rotation generally coincident with the central axis of the spindle and a bearing race concentrically disposed relative to the central axis of the cone and having a wall lying in a plane generally normal to the central axis of the cone, the wall of the bearing race of the cone being spaced apart from and generally parallel to the back wall of the bearing race of the spindle;

a thrust bearing mounted within the bearing race of the spindle and the bearing race of the cone and extending between the back wall of the bearing race of the spindle and the wall of the bearing race of the cone, the thrust bearing having an outer diameter and an inner diameter; and a main roller having disposed between the spindle and the cone to facilitate rotation of the cone on the spindle, the main roller bearing being disposed adjacent the inner diameter of the thrust bearing.

16. Apparatus in accordance with claim 15, further including a second thrust bearing of substantially smaller size than the first-mentioned thrust bearing, the second thrust bearing being disposed between the spindle and the cone on an opposite side of the main bearing from the first-mentioned thrust bearing.

17. Apparatus for use in a drill bit comprising a leg having a generally conically shaped spindle at an end thereof, the spindle having a central axis and including a main bearing race therein concentrically disposed relative to the central axis, a thrust bearing race therein concentrically disposed relative to the central axis, the thrust bearing race being disposed outside of the main bearing race so that the main bearing race and the thrust bearing race form a generally open face configuration on the spindle, and an aperture extending through the spindle and the leg along the central axis of the spindle between opposite outer surfaces of the leg, the aperture facilitating mounting of the leg during formation of the spindle including the main bearing race and the thrust bearing race by grinding.

18. Apparatus in accordance with claim 17, further including a pressure compensator disposed within the aperture.

19. Apparatus for use in a drill bit comprising a leg terminating in a spindle at an end thereof, the spindle having a central axis and being adapted to rotatably receive a drilling cone thereon, the leg having an aperture therein extending between opposite surfaces of the leg along the central axis of the spindle and, a pressure compensator disposed within the aperture, the aperture having an enlarged portion thereof in which the pressure compensator is disposed, and the pressure compensator including a flexible bellows disposed within the enlarged portion of the aperture.

20. Apparatus for use in a drill bit comprising the combination of:

a leg;

a cone rotatably mounted on the leg and forming an interface therewith;

at least one bearing disposed between the leg and the cone between an inner portion and a radial outer portion of the interface; and means within the leg for recirculating lubricating oil from the radial outer portion of the interface of the inner portion of the interface for supply to a region encompassing the at least one bearing.

21. Apparatus in accordance with claim 20, wherein the means for recirculating includes means for cooling the lubricating oil.

22. Apparatus in accordance with claim 21, wherein the means for recirculating includes means for removing metallic particles from the lubricating oil.

23. Apparatus in accordance with claim 22, wherein the means for removing metallic particles from the lubricating oil comprises a magnetic bushing.

24. Apparatus in accordance with claim 21, wherein the means for cooling includes radiator apparatus mounted within the leg.

25. Apparatus in accordance with claim 24, wherein the radiator apparatus comprises a heat exchange plate within the leg adjacent an outer surface of the leg, the heat exchange plate forming a groove through which the lubricating oil is recirculated, the groove having a tortuous zig-zag path for the lubricating oil therein.

26. Apparatus in accordance with claim 20, wherein the means for recirculating lubricating oil includes a flow-restricting bushing, the bushing being operative to prevent surging of lubricating oil in response to sudden movement of the cone toward the leg.

27. Apparatus for use in a drill bit comprising the combination of:

a leg;

a cone rotatably mounted on the leg; and a seal disposed between the leg and the cone, the seal engaging both the leg and the cone and being free to slide relative to both the leg and the cone when the cone rotates on the leg, the seal having an outer surface having a plurality of concentric ribs thereon to facilitate sliding of the seal relative to the leg and the cone.

28. Apparatus for use in a drill bit comprising the combination of:

an elongated leg having a cone-mounting end thereof with an outer edge at the end of an outer surface of the leg; and a cone rotatably mounted on the cone-mounting end of the leg, the cone having an outer rim at a base portion thereof of greatest diameter adjacent the outer edge of the cone-mounting end of the leg, a generally conical surface on one side of the outer rim, and an extended portion thereof on a side of the outer rim opposite the conical surface which extends outwardly beyond the outer surface of the leg adjacent the outer edge of the cone-mounting end to space the outer surface of the leg and the included outer edge from the wall of a hole being drilled and thereby protect the outer edge of the cone-mounting end of the leg.

29. Apparatus in accordance with claim 28, further comprising a plurality of ceramic buttons mounted in the extended portion of the cone, the ceramic buttons helping to resist wear of the extended portion of the cone.

30. Apparatus in accordance with claim 28, further comprising a coating of abrasion-resistant material covering a portion of the leg adjacent the cone.

31. Apparatus in accordance with claim 28, further comprising a generally ring-shaped nut secured to the extended portion of the cone, the nut extending over and having an inside diameter smaller than the outer edge of the cone-mounting end of the leg to prevent removal of the cone from the leg.

32. Apparatus in accordance with claim 31, wherein the nut has an outer face of wear resistant material which angles away from the outer rim of the cone.

33. Apparatus in accordance with claim 31, further comprising a washer seal disposed between and sealing the space between the nut and the leg.

34. Apparatus in accordance with claim 33, wherein the washer seal is generally ring-shaped and is slidably disposed adjacent both the nut and the leg so as to be slidable relative to both the nut and the leg when the cone and the nut are rotated relative to the leg.

35. Apparatus in accordance with claim 34, wherein the washer seal is made of rubber having solid particles of lubricant embedded therein.

36. Apparatus for use in a drill bit comprising the combination of:

an elongated leg having a cone-mounting end thereof with an outer edge;

a cone rotatably mounted on the cone-mounting end of the leg, the cone having an outer rim at a base portion thereof of greatest diameter adjacent the outer edge of the cone-mounting end of the leg, a generally conical surface on one side of the outer rim, and an extended portion thereof on a side of the outer rim opposite the conical surface which extends over and protects the outer edge of the cone-mounting end of the leg;

a generally ring-shaped nut secured to the extended portion of the cone, the nut extending over and having an inside diameter smaller than the outer edge of the cone-mounting end of the leg to prevent removal of the cone from the leg;

a washer seal disposed between and sealing the space between the nut and the leg, the washer seal being generally ring-shaped and slidably disposed adjacent both the nut and the leg so as to be slidable relative to both the nut and the leg when the cone and the nut are rotated relative to the leg; and a pre-seal disposed between the cone and the leg on the opposite side of the washer seal from the nut, the pre-seal being slidable relative to both the nut and the leg when the cone and the nut are rotated relative to the leg.

37. Apparatus for use in a drill bit comprising the combination of:

a leg;

a cone rotatably mounted on the leg and having a portion of greatest diameter at an outer rim at a base thereof and a generally conical portion on one side of the outer rim;

a nut secured to the cone at a portion of the cone on an opposite side of the outer rim from the generally conical portion, the nut extending over the leg and acting to secure the cone on the leg;

a washer seal disposed between and sealing the space between the nut and the leg, the washer seal being slidably disposed against both the nut and the leg so as to be slidable relative to both the nut and the leg when the cone and the nut are rotated relative to the leg; and a pre-seal slidably disposed against both the cone and the leg, on an opposite side of the washer seal from the nut, the pre-seal being slidable relative to both the cone and the leg when the cone is rotated relative to the leg.

38. Apparatus for use in a drill bit comprising the combination of:

a leg;

a cone rotatably mounted on the leg and having a portion of greatest diameter at an outer rim at a base thereof and a generally conical portion on one side of the outer rim;

a nut secured to the cone at a portion of the gone on an opposite side of the outer rim from the generally conical portion, the nut extending over the leg and acting to secure the cone on the leg; and a washer seal disposed between and sealing the space between the nut and the leg, the washer seal being generally ring-shaped and having a plurality of concentric ribs on an outer surface thereof.

39. Apparatus in accordance with claim 38, further comprising a quantity of non-water soluble grease disposed on the plurality of concentric ribs.

40. Apparatus in accordance with claim 38, wherein the washer seal has a first surface slidably engaging the nut and an opposite second surface slidably engaging the leg, and the plurality of concentric ribs are disposed on both the first surface and the second surface.

41. A method of mounting a cone on the spindle of a leg in a drill bit, comprising the steps of:

providing a leg having a spindle with a threaded portion;

providing a cone;

providing a lock nut;

temporarily securing the lock nut at the inside of the cone while rotating the spindle relative to the cone to screw the lock nut onto the threaded portion of the spindle and secure the cone against removal from the spindle;

releasing the lock nut at the inside of the cone so that the cone is thereafter free to rotate relative to the spindle;

providing a ring-nut; and screwing the ring-nut onto an extended outer portion of the cone simultaneously with screwing of the lock nut onto the threaded portion of the spindle.

* * * * *

UNITED STATES PATENT AND TRADEMARK OFFICE

CERTIFICATE OF CORRECTION

PATENT NO. : 5,137,097

DATED : August 11, 1992

INVENTOR(S) : Carlos Fernandez

It is certified that error appears in the above-identified patent and that said Letters Patent is hereby corrected as shown below:

Claim 4, column 31, line 25, before "for delivering", change "thereon" to --therein--.

Claim 7, column 31, line 57, after "outer" and before "located" insert --periphery of the cone and the roller thrust bearing being--.

Claim 16, column 33, line 33, after "main" and before "bearing" insert --roller--.

Claim 26, column 34, line 31, before "of the cone", "movement" should be --movements--.

UNITED STATES PATENT AND TRADEMARK OFFICE

CERTIFICATE OF CORRECTION

PATENT NO. : 5,137,097

DATED : August 11, 1992

INVENTOR(S) : Carlos Fernandez

It is certified that error appears in the above-indentified patent and that said Letters Patent is hereby corrected as shown below:

Claim 38, column 36, line 23, after "portion of the", "gone" should be --cone--.

Signed and Sealed this

Twenty-eighth Day of September, 1993

*Attest:*

*Attesting Officer*

BRUCE LEHMAN

*Commissioner of Patents and Trademarks*